US009554611B2

(12) United States Patent
Arrouart

(10) Patent No.: US 9,554,611 B2
(45) Date of Patent: Jan. 31, 2017

(54) FOLDABLE PROTECTIVE HELMET

(75) Inventor: Philippe Arrouart, Sceaux (FR)

(73) Assignee: OVERADE, Sceaux (FR)

( * ) Notice: Subject to any disclaimer, the term of this patent is extended or adjusted under 35 U.S.C. 154(b) by 83 days.

(21) Appl. No.: 13/387,344

(22) PCT Filed: Jul. 9, 2010

(86) PCT No.: PCT/EP2010/059904

§ 371 (c)(1),
(2), (4) Date: Apr. 4, 2012

(87) PCT Pub. No.: WO2011/012426

PCT Pub. Date: Feb. 3, 2011

(65) Prior Publication Data

US 2012/0216338 A1 Aug. 30, 2012

(30) Foreign Application Priority Data

Jul. 29, 2009 (FR) ..... 09 55303

(51) Int. Cl.
*A42B 3/00* (2006.01)
*A42B 3/32* (2006.01)

(52) U.S. Cl.
CPC ..... *A42B 3/322* (2013.01)

(58) Field of Classification Search
CPC ..... A42B 1/08; A42B 1/22; A63B 2243/0004; A63B 2243/0041; A63B 2243/005; A63B 2243/007; A63B 71/10; B32B 2347/04
USPC ..... 2/410, 411, 417, 418, 420, 425
See application file for complete search history.

(56) References Cited

U.S. PATENT DOCUMENTS

| | | | | |
|---|---|---|---|---|
| 4,472,472 | A * | 9/1984 | Schultz | 428/178 |
| 5,345,614 | A * | 9/1994 | Tanaka | 2/425 |
| 6,159,324 | A * | 12/2000 | Watters et al. | 156/242 |
| 6,209,139 | B1 | 4/2001 | Schmidt et al. | |
| 6,647,556 | B2 * | 11/2003 | Grepper et al. | 2/425 |
| 6,996,856 | B2 * | 2/2006 | Puchalski | 2/411 |
| 7,076,811 | B2 * | 7/2006 | Puchalski | 2/411 |
| 7,958,572 | B2 * | 6/2011 | Loury et al. | 2/410 |
| 2002/0023290 | A1 * | 2/2002 | Watters et al. | 2/410 |
| 2005/0034223 | A1 * | 2/2005 | Durocher | 2/425 |
| 2005/0257312 | A1 | 11/2005 | Puchalski | |
| 2007/0157370 | A1 * | 7/2007 | Joubert Des Ouches | 2/410 |

FOREIGN PATENT DOCUMENTS

| | | | | |
|---|---|---|---|---|
| DE | 20 2004 012 285 U1 | | 11/2004 | |
| JP | 07310220 | | 11/1995 | |
| WO | WO 96/21371 | | 7/1996 | |
| WO | WO 2007/068846 | * | 6/2007 | A42B 3/32 |

* cited by examiner

*Primary Examiner* — Anna Kinsaul
(74) *Attorney, Agent, or Firm* — Blakely Sokoloff Taylor & Zafman LLP

(57) ABSTRACT

The invention relates to a protective helmet comprising a plurality of segments, at least two of said segments (106, 107) being connected together by way of a sliding connection for sliding purposes, said segments connected by said connection having complementary and approximately parallel indentations and protrusions, characterized in that, for each sliding connection, said protrusions of at least one of the segments are connected together by way of a transverse bar.

9 Claims, 29 Drawing Sheets

FOLDABLE PROTECTIVE HELMET

This is a non-provisional application claiming the benefit of International Application Number PCT/EP2010/059904, filed Jul. 9, 2010.

GENERAL TECHNICAL DOMAIN

The invention relates to the technical domain of helmets, and more particularly helmets for cycles or motorcycles.

STATE OF PRIOR ART

A user is required to wear a helmet for many activities such as cycling and motorcycling, or if he is not required, at least it is strongly recommended.

A conventional protective helmet is shown in FIG. 1.

The helmet 1 shown comprises an outer shell 2 conventionally made from a thin layer of hard material to resist shocks.

A layer of material called the padding 2' is located inside this outer shell 2, and is designed to dampen shocks.

Preferably, the outer shell 2 is made from polycarbonate, ABS (Acrylonitrile Butadiene Styrene), PET (PolyEthylene Terephthalate), polyamide or a composite material. The padding 2' is usually composed of a synthetic foam such as expanded polystyrene, polyurethane, polypropylene, or any other absorbent material. The padding 2' may be composed of several layers of material.

Conventionally, the protective helmet is provided with a chin strap type retention system. It is advantageously fitted with an adjustable headband and/or foam pads with different thicknesses fixed on the inside wall of the helmet by means of Velcro™ type self-gripping fasteners, to fit the user's head. These systems are known and are not shown in the figures.

The helmet may also be provided with a lighting system, a visor, reflecting devices and decorations. These accessories may be removable, glued or fixed by any appropriate means.

Stiffeners for example made from metal or composite material, can be inserted inside the helmet to improve its mechanical strength. For example, these stiffeners are insert moulded into the outer shell 2 or into the padding 2'.

The helmet may so provided with vents to improve cooling of the head. These vents may be closed off by caches made of plastic or a flexible material to protect the user from rain and cold. These caches may for example be clipped in place, or fastened by means of self-gripping fasteners or press studs.

The outer shell 2 and the padding 2' are shown in FIG. 1, but variant helmets exist in which the outer shell 2 or padding 2' is partially or entirely missing, for example construction site helmets that do not have a padding 2'.

These helmets must satisfy demanding safety standards, to provide good protection for the user.

These constraints result in large helmets that are not very practical in use. A cycle or a motorcycle can be used as a transport mean as well as simple activity; consequently, once the journey is finished, the user must put the helmet away. Therefore it is desirable that the helmet size should be minimised, provided that it satisfies the above-mentioned safety criteria.

Document WO 2007/068846 discloses a foldable protective helmet. However, the solution disclosed in this document leads to discontinuities in the helmet, and particularly undesirable spaces between the different segments making up the helmet, which can be a hindrance for the user and make the helmet more vulnerable to shocks.

PRESENTATION OF THE INVENTION

The invention is aimed at solving this problem, and it discloses a protective helmet comprising a plurality of segments, at least two of said segments being connected to each other by means of a sliding connection for sliding purposes, said segments connected by said sliding connection being provided with indentations and approximately parallel complementary protrusions, characterised in that said protrusions from at least one of the segments are connected to each other through a transverse bar, for each sliding connection.

Said helmet may advantageously have one or several of the following characteristics:

- the protrusions from each of the segments are connected to each other by means of a transverse bar, said transverse bars being adapted to maintain a connection between the two segments of a sliding connection, preventing any disengagement;
- one of said segments comprises at least one overlap element that connects the bar to said segment and is superposed on at least one of the protrusions from the other segment of said sliding connection;
- at least one of the ends of said transverse bars extends beyond the protrusions, said ends of the transverse bars extending beyond the protrusions are guided in displacement by guide elements arranged a ng the indentations;
- at least one of the indentations is at least partially covered by a guide element, said guide element being adapted to guide the displacement of the segment complementary to the segment comprising said at least one indentation;
- said guide elements do not extend over entire length of said indentations;
- at least one of said protrusions is provided with a stop, said stop being adapted to block the movement of said transverse bars along the sliding direction;
- at least one bar covers at least one protrusion and/or one indentation in the same segment, defining an internal space between said bar and the segment, and being adapted to guide the displacement of the transverse bar of the complementary segment;
- at least one of said protrusions and/or indentations of a first segment is covered by a first shell, said first shell defining an internal space between the first shell and the first segment, and being adapted to guide the displacement of the transverse bar of the second segment associated with said first segment;
- at least one of F protrusions and/or indentations of said associated segment is covered by a second shell, said second shell defining a second internal space between the second shell and the associated segment, and being adapted to enable displacement of the first shell and the transverse bar of the first segment.

PRESENTATION OF THE DRAWINGS

Other characteristics, purposes and advantages of the invention will be clear from the following description that is given purely for illustrative and non-limitative purposes, and that should be read with reference to the appended drawings in which:

FIGS. 47, 52, 57, 62, 67, 72, 76, 80, 84, 86, 89 and 94 are top sectional views of different embodiments of the locking device in the locked position.

FIGS. 48, 53, 58, 63, 68, 73, 77, 81, 85, 87 and 95 are top sectional views of the different embodiments of the locking device in the unlocked position.

FIGS. 96, 97, 100, 102, 104, 105, 108, 109, 112, 113, 116, 117, 120, 121, 123, 124, 126, 127, 129, 130, 132, 133, 136, 137, 140, 141, 144, 145, 147 and 148 show variants of the helmet in the extended position.

FIGS. 98, 99, 101, 103, 106, 107, 110, 111, 114, 115, 118, 119, 122, 125, 128, 131, 134, 135, 138, 139, 142, 143, 146 and 149 show variants of the helmet in the folded position.

Similar elements have identical numeric references on all figures.

DETAILED DESCRIPTION

We will now present several aspects that can be applied to a helmet according to the invention. These aspects may be advantageous in themselves, independently of each other. An arbitrary number of these aspects can also be combined so as to combine their advantages. Some combinations also have synergies that will be mentioned.

In the figures showing hinge connections, sliding connections and tacking devises, segments 3 and 4 of a protective helmet are shown, these segment 3 and 4 being connected by miscellaneous connecting means or locking means.

As mentioned above, the helmet 1 comprises an outer shell 2 and/or a padding 2'.

In the embodiments shown, the helmet 1 is composed of several segments, each of these segments being composed of a segment of an outer shell 2 and a segment of a padding 2'.

It will be understood that these embodiments can be adapted to cases in which the outer shell 2 or padding 2' is entirely or partially missing from at least one segment.

Furthermore, the outer shell 2 and/or the padding 2' of a segment may be composed of several parts.

Figure 2:
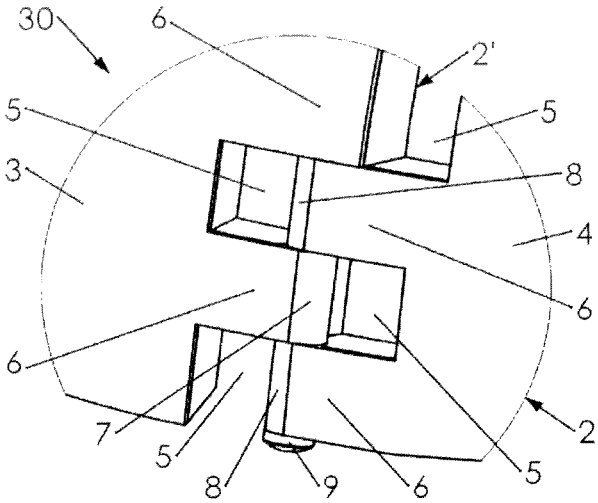
FIGS. 2, 3 and 4 show a hinge connection tangent to the surface of the helmet.
Figure 3:
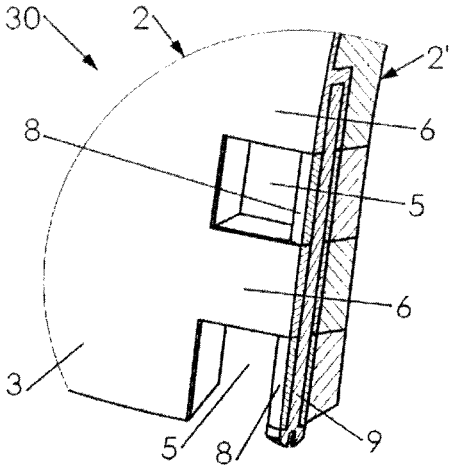
Figure 4:
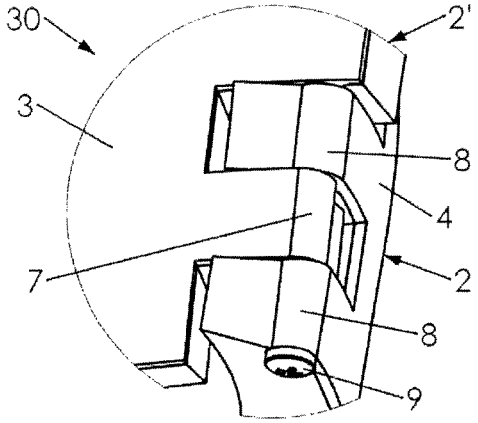

Hinge Connection:

FIGS. 2, 3 and 4 show a hinge connection 30 tangent to the surface of the helmet.

FIG. 2 shows a part of the outer surface of the helmet 1 in the extended position, with a slight perspective.

The view shown in FIG. 3 is a sectional view in a plane containing the hinge connection pin and perpendicular to the surface of the helmet 1.

The protective helmet 1 comprises a plurality of segments, in this case segments 3 and 4, these segments 3 and 4 being hinged to each other by a hinge connection 30.

FIG. 4 shows segments 3 and 4 in their folded position.

In the embodiment shown in FIGS. 2 to 4, said segments 3 and 4 comprise indentations 5 and complementary protrusions 6, at the ends of which a hinge 30 is located composed of knuckles 7 and 8 in which the rotation pin 9 of said hinge connection 30 is located, in this case composed a screw.

Knuckles 7 and 8 arranged on segments 3 and 4 respectively, may be set back from the ends of the protrusions 6.

Indentations 5 also enable displacement of the segments 3 and 4 taking account of their thickness and their curvature, namely rotation of segments that is not hindered due to the position of the rotation pin 9 of the hinge connection 30; therefore the depth of the indentations 5 is preferably at least equal to the total thickness of the segments 3 and 4 to enable rotation of the segments.

If pivoting of the hinge connection 30 is limited, the indentations 5 do not have to be so deep over all or some of the thickness of the segments 3 and 4.

In the particular embodiment in which segments 3 and 4 pivot only towards the outside of the helmet 1, there may be no through indentations 5 in segments 3 and 4, in this case they will comprise only thinner zones facing the protrusions 6.

Obviously the number of knuckles and their geometry and dimensions an vary, the embodiment shown simply being one example.

The function of the knuckles 7 and 8 is to guide the pin 9 of the hinge connection 30, and to block segments 3 and 4 together to prevent any relative movement of these segments along the direction of the pin 9.

The knuckles 7 and 8 may form an integral part of segments 3 and 4, or they may be add-on parts fixed onto segments 3 and 4 by screwing, crimping, riveting, gluing, welding, insert moulding or any other appropriate assembly means. They may be arranged on the outside of the surface of the helmet 1, or embedded in segments 3 and 4 as shown in FIGS. 2 and 3.

The rotation pin 9 of the hinge 30 is tangent to or approximately tangent to the surface of the segments 3 and 4 of the helmet 1. However, it is not possible to be tangent at all points along the pin due to the rounded geometry of segments 3 and 4 of the helmet 1, for aesthetic and dynamic reasons and for the user's comfort. Therefore the pin 9 is tangent to the surface at one point, and its straight configuration is such that it moves slightly away from this surface on each side of the tangent point.

The rotation pin 9 of the hinge 30 may for example be screwed, crimped, riveted or glued to one of the segments 3 or 4.

The rotation pin 9 in this case consists of a screw, and is located in a channel passing through the knuckles 7 and 8 that may or may not open up at each end of said knuckles 7 and 8.

Several other variants are possible; for example, the rotation pin 9 may be composed of a rivet, or it may be force fitted into one of the two segments, which avoids the need for the cavity containing the rotation pin 9 in the knuckles to open up at the two ends of the hinge 30, in this case a single end being open through which the rotation axis 9 is force fitted, which has an aesthetic advantage over embodiments in which both ends are open.

Figure 6:
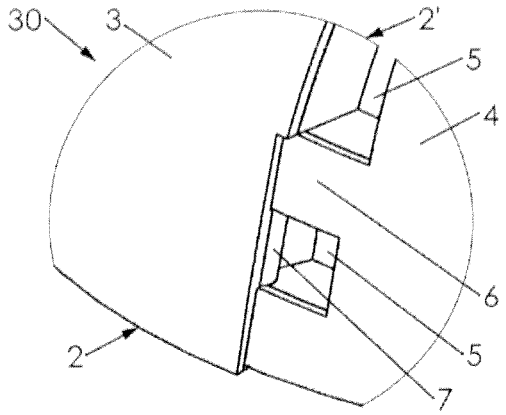
Figure 7:
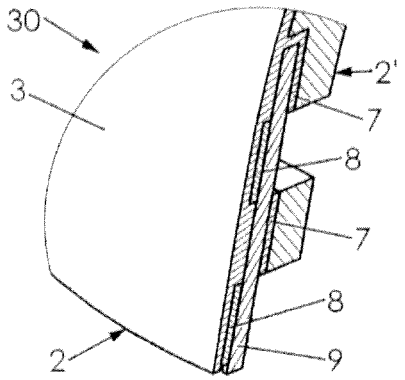

FIGS. 6 and 7 show an embodiment with only one open end.

According to another possible embodiment, an elastic ring is housed in a groove located in the rotation pin, said elastic ring being held in place between the knuckles 7 and 8 so that the rotation pin 9 can be locked in the axial direction.

Another possible axial locking method could consist of a tab on the rotation pin 9 that is elastically deformable during assembly of the hinge connection 30, that would be housed in an opening located in one of the knuckles 7 or 8, and that would result in axial locking of the rotation pin 9.

Figure 5:
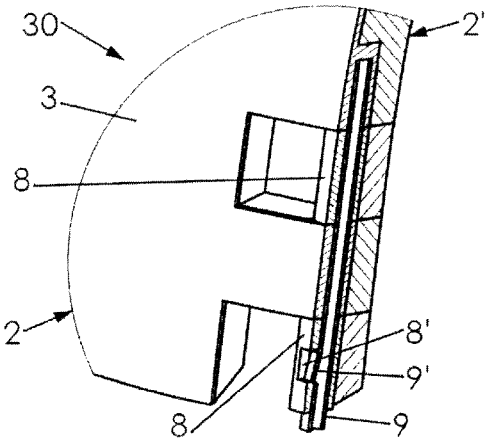
FIGS. 5 to 13 show other embodiments of the hinge connection tangent to the surface of the helmet.

This particular embodiment including this type of axial locking is shown in FIG. 5; the rotation axis 9 comprises a tab 9' that is housed in an opening 8' located in one of the knuckles 8.

It could also be advantageous if the knuckles 7 and 8 comprise openings arranged alternately on each side of the outer surface of segments 3 and 4, to simplify manufacturing of these parts if they are moulded.

Figure 8:
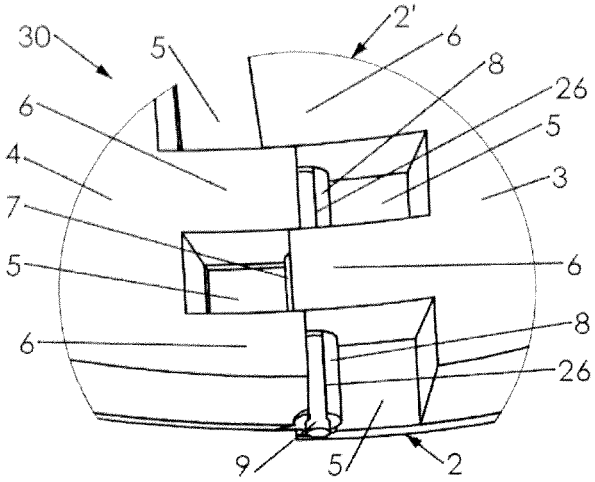
Figure 9:
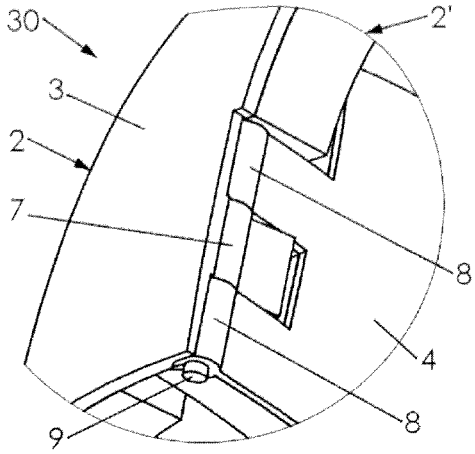

According to the variant shown in FIGS. 6 to 9, the knuckles 8 fixed to the segment 4 are provided with openings 26 over their entire length. They are guided by the outer shell 2 of the segment 3 and the pin 9 of the hinge connection 30. This embodiment simplifies manufacturing of the outer shell of the segment 4. Segments 3 and 4 are shown in the extended position in FIG. 6, and in the folded position in FIG. 9. FIG. 7 shows a sectional view of FIG. 6. FIG. 8 is a view from the inside of the helmet, in the extended position. The pin 9 may form an integral part of the segment 3, and in this case the opening 26 located in the knuckles 8 acts as a passage for the pin 9 when the hinge connection 30 is assembled.

Figure 10:
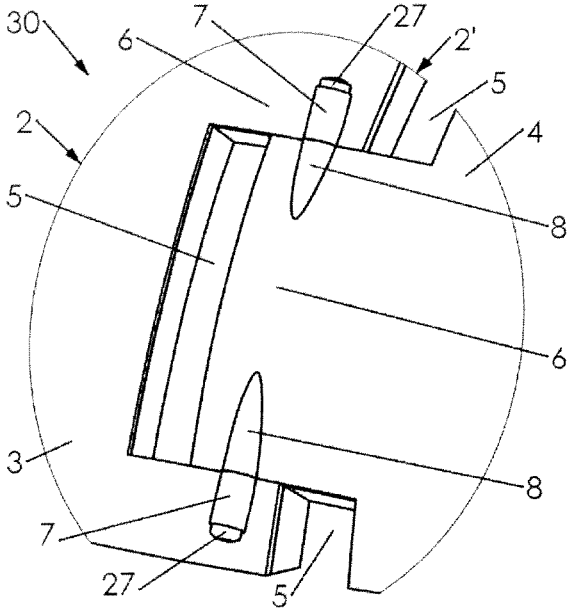
Figure 11:
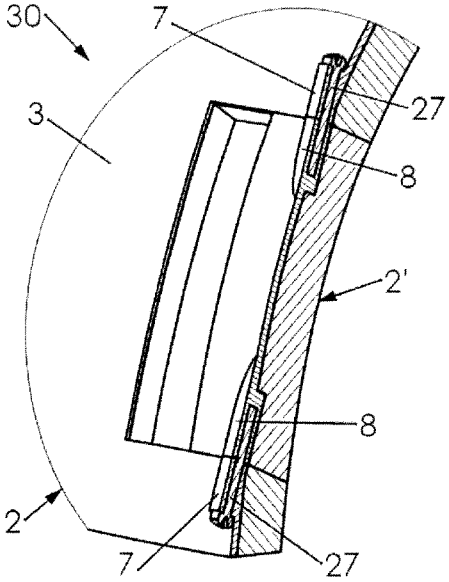

The rotation pin 9 may also be composed of several elements; for example two screws 27, each screw being fixed to one of the ends of the rotation pin 9. It may then be advantageous if these two screws 27 do not touch each other at the centre of the pin, so that the thickness of the segments is not affected. FIGS. 10 and 11 show such an embodiment.

Figure 12:
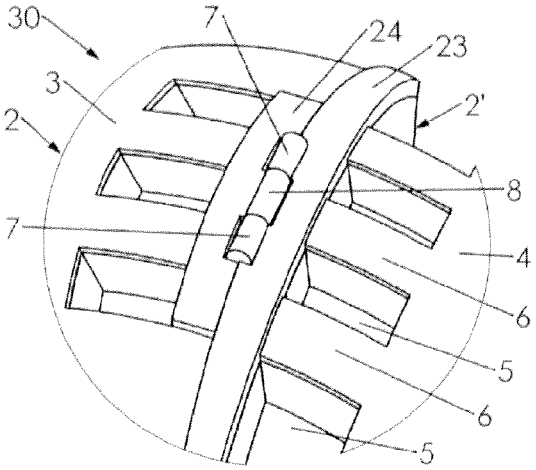
Figure 13:
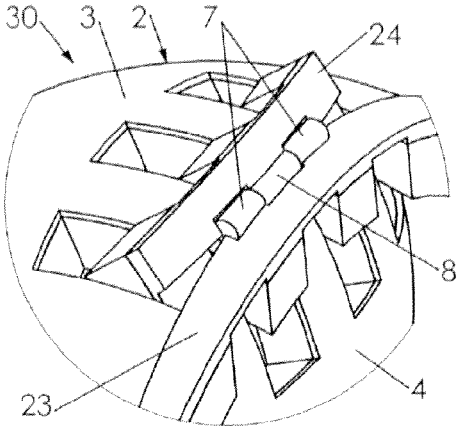

According to another embodiment shown in FIGS. 12 and 13, the pin of the hinge connection 30 is set back from the ends of the protrusions 6. Transverse bars 23 and 24 are then fixed to segments 3 and 4 respectively, between the ends of the protrusions and the knuckles 7 and 8. These transverse bars 23 and 24 that connect the protrusions on a single segment can limit the rotation of the hinge connection 30. As a variant, a transverse bar night be provided on only one segment. If there is a transverse bar 23 and 24 on each of the two segments 3 and 4, it is preferable it at least one of the two bars 23 and/or 24 is fixed at the time that the hinge connection 30 is assembled.

Such a hinge connection 30 tangent to the surface of the helmet 1 enables relative rotation of segments 3 and 41 making up the helmet 1, so that the helmet 1 can be moved from a usage position, in other words the extended position, to a folded and more compact position, easier to handle and to put away.

Note that in the different variants shown in the figures, hinge connections form an integral part of the structural elements of the helmet 1 and more particularly the outer shell, making this helmet 1 stronger than when connection means are added onto the helmet.

Obviously, it should be understood that other embodiments are possible.

Figure 14:
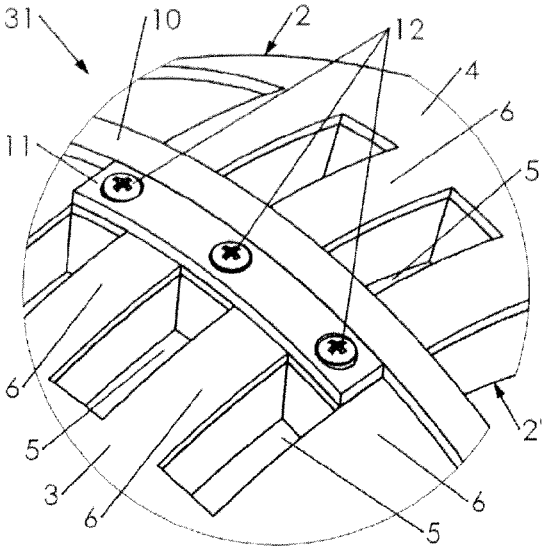
FIGS. 14, 15 and 16 show the protective helmet comprising a sliding connection.
Figure 15:
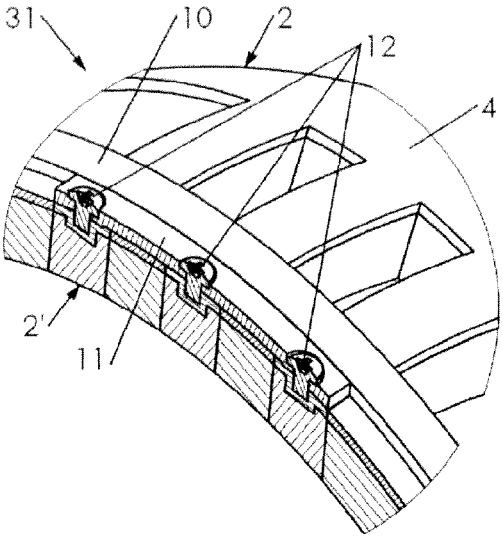
Figure 16:
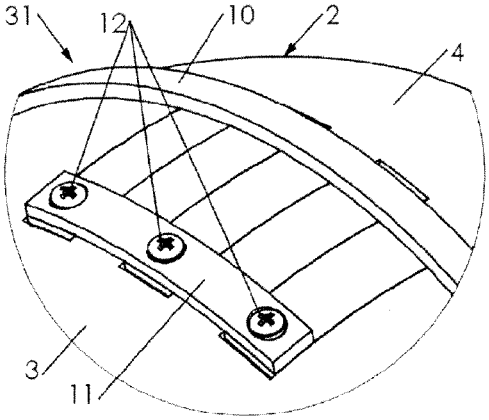

Sliding Connection:

FIGS. 14, 15 and 16 show part of the protective helmet 1 comprising a sliding connection 31.

As above, the protective helmet 1 is composed of segments 3 and 4, these segments being connected to each other by a sliding connection 31.

These segments 3 and 4 comprise indentations 5 and complementary protrusions 6 that are located facing each other on each of segments 3 and 4; each protrusion. 6 from a segment 3, 4 is located facing an indentation 5 in the other segment 4, 3. Thus, a sliding movement of segments 3 and relative to each other would engage the indentations 5 in one segment into the protrusions 6 in the other segment, and vice versa.

These indentations 5 and protrusions 6 typically extend through the entire thickness of segments 3 and 4, in other words through the entire thickness of the segments of the outer shell and/or the segments of the padding from which the segments 3 and 4 are composed, so as to form openings or vents in the wall of the helmet.

At the end of the protrusions t of each segment 3 and 4, there are transverse bars 10 and 11 respectively (in other words they are installed transverse to the direction of projection of the protrusions 6, which is also the direction along which the protrusions 6 slide in the indentations 5).

The transverse bars 10 and 11 may also be located set back from the ends of the protrusions 6, which affects the sliding distance.

However, this illustrated embodiment is not limitative; it would be possible for only the protrusions 6 from a single segment 3 or 4 to be connected through a transverse bar 10 or 11. The protrusions 6 from the other segment of the sliding connection 31 may then comprise adapted complementary means such as stops or tabs.

Obviously, the number of indentations 5 and protrusions 6, their geometry and dimensions, and the shape of the transverse bars 10 and/or 11 can vary.

The transverse bars 10 and/or 11 may form an integral part of the segments 3 and/or 4 or they may be added en and fixed for example by screwing, gluing, riveting, crimping, clipping or welding, or by any other attachment means, these transverse bars 10 and/or are typically arranged on the outer face of the shell of the helmet 1. In the case in which the two segments 3 and 4 each comprises a transverse bar 10 and 11, it is preferable if one of the two bars 10 or 11 is added on after the two segments 3 and 4 have been engaged together.

In the embodiment shown, the transverse bar 10 forms an integral part of the segment 3 while the transverse bar 11 is fixed using the screw 12 to the segment 4. It will be seen that the attachment of the transverse bar 11 to the segment 4 is made while the protrusions 6 from the segment 4 are at least partially inserted into the indentations 5 of the segment 3. Thus, once the transverse bar 11 has been screwed to the segment 4, the bar maintains the link between the two segments 3 and 4 by preventing any disengagement.

FIG. 14 shows segments 3 and 4 in their extended position in which the indentations 5 are free and thus form openings or vents in the wall of the helmet 1.

FIG. 15 shows a sectional view of FIG. 14.

FIG. 16 shows segments 3 and 4 in their folded position in which the indentations 5 are occupied by protrusions 6 from the complementary segment. This creates a saving of space approximately equal to the length of the protrusions 6 and the indentations 5 of segments 3 and 4.

Each through indentation may be replaced by a zone that thinner than the segment. The protrusion 6 belonging to the complementary segment located facing said indentation 5 is then also thinner.

If each of the two segments 3 and 4 is provided with a bar 10 and 11, the protrusions 6 may be provided with one or several stops 28 that prevent movement of said bars 10 and 11 along the direction of sliding, and therefore movement of segments 3 and 4 along this direction, in the folding direction. The advantage in this case is that relative displacement of segments 3 and 4 is prevented when the helmet 1 is in the extended position. The user will then for example have to pivot one segment 3 or 4 relative to the other, in order to allow sliding.

Figure 18:
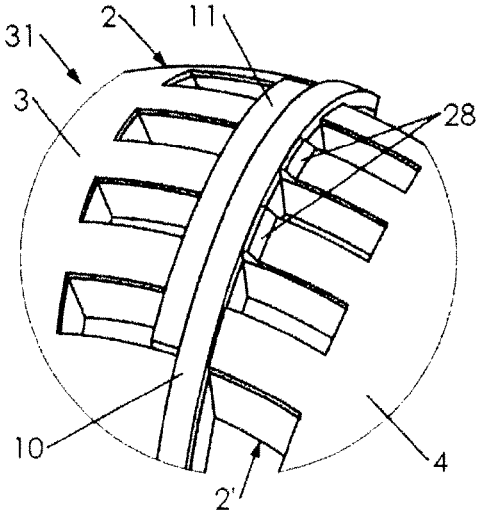
Figure 19:
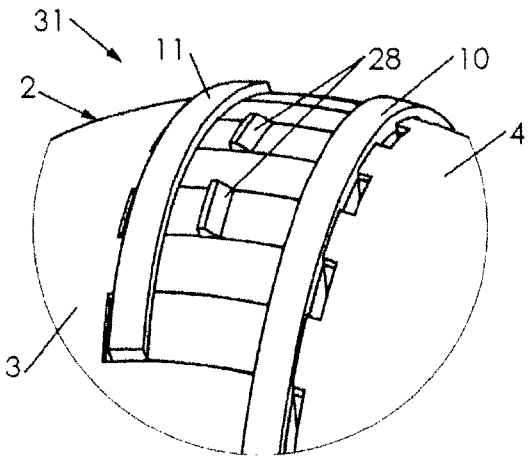

FIGS. 18 and 19 show such an embodiment comprising stops 28.

According to another embodiment, one or both ends of at least one of the transverse bars 10 and 11 projects beyond the protrusions from segments 3 and 4. According to one particular variant of this embodiment, the movement of said ends of the transverse bar(s) 10 and/or 11 projecting beyond the protrusions may be guided by guide parts, said guide parts being arranged along the indentations 5 and possibly for example being fixed to one or the other of the segments 3 or 4.

The combination of the projection of the ends of the bar(s) 10 and/or 11 and the guide parts can limit the rotation movement of the connection.

The guide part(s) may be present over all or some of the length of the indentations 5, the fact that they are not present over the entire length of the indentations 5 enables pivoting of the connection at the end of the travel distance when the end of the transverse bar is not guided by at least one guide part.

Guide parts may be in the form of protuberances in which a slit is formed in which the transverse bar 10 and/or 11 is inserted, or raised portions parallel to the protrusions 6, and guiding the movement of the transverse bars 10 and/or 11.

Figure 17:
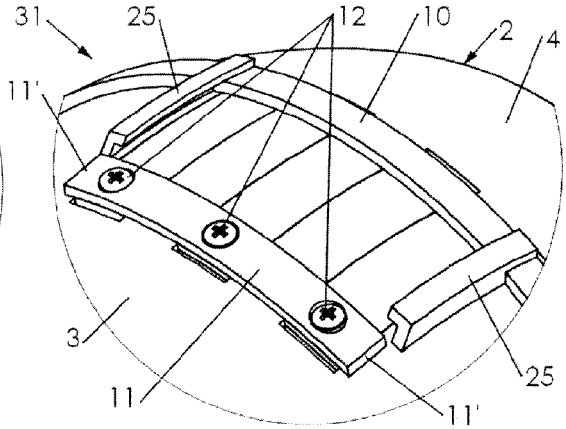
FIGS. 17 to 32 show other embodiments of sliding means for a protective helmet.

This variant is shown in FIG. 17 in the folded position; the transverse bar 11 can be seen, the ends 11' of which project beyond the protrusions 6 of the segment 4, and the guide parts 25 extending over part of the length of the indentations 5 of the segment 3.

Figure 20:
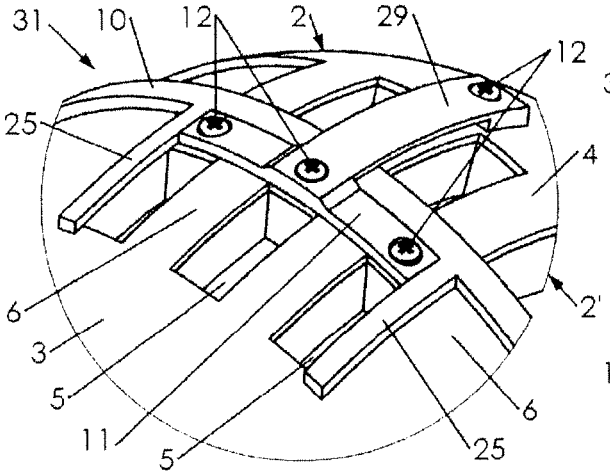
Figure 21:
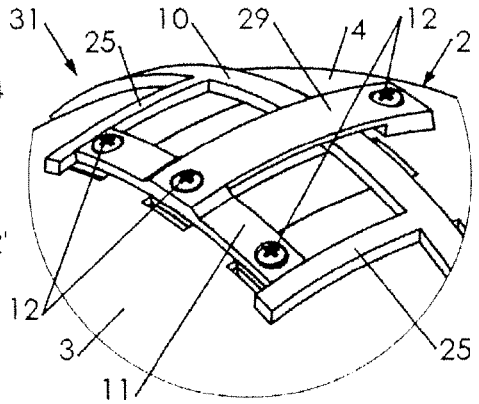
Figure 22:
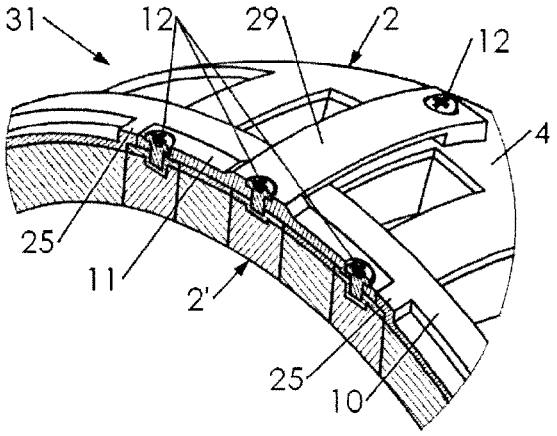

If the guide parts 25 at least partially cover the indentations 5 along which they are located, the limitation of the rotation movement of the sliding connection 31 may be made without the ends of the transverse bars 10 and/or 11 projecting beyond the protrusions 6. The guide part 25 then guides either the transverse bar 10 or 11, or the protrusion 6 of the complementary segment directly. FIGS. 20 to 22 show such an embodiment.

The sliding connection 31 may combine one or several guide parts 25 with one or several stops 28.

According to the variant ON in FIGS. 20 to 22, a slat 29, in this case fixed to the transverse bar 11, covers a protrusion 6 from the segment 4. An inner space is then defined between the slat 29 and the segment 4, inside which the transverse bar 10 translates.

More generally, one or both segments 3 and/or 4 connected by the sliding connection 31 may be provided with one or several slats 29, covering at least one indentation 5 and/or one protrusion 6.

The slats 9 may be associated with one or several guide parts 25, as is the case in the embodiment described, thus improving the guide of the sliding connection 31.

As a variant, only one of the two segments 3 or 4 comprises a transverse bar 10 or 11, the other segment being fitted with at least one slat 29.

Figure 23:
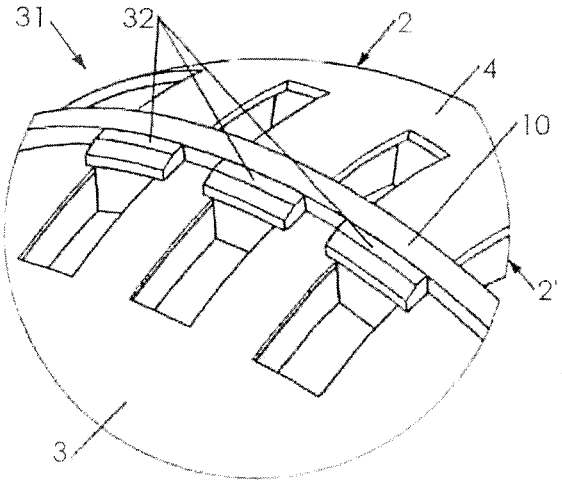
Figure 24:
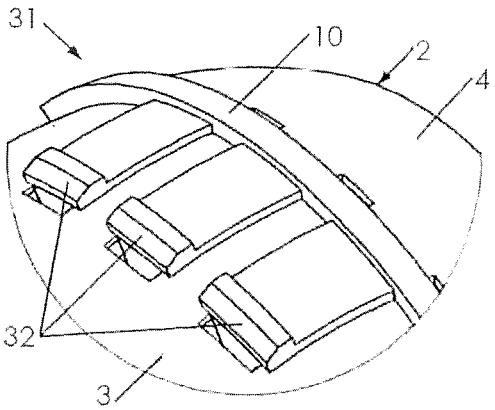
Figure 25:
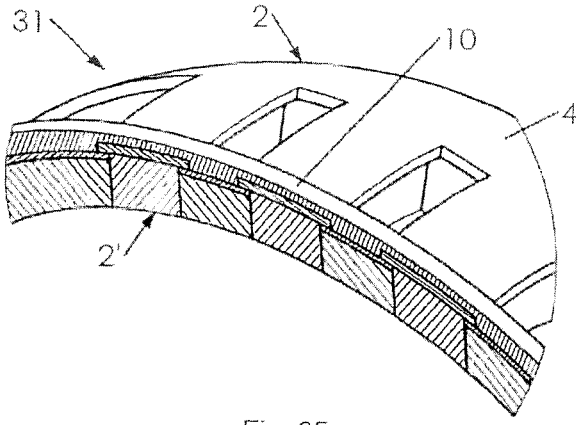

According to one embodiment shown in FIGS. 23 to 25, the protrusions 6 from the segment 3 are connected to each other by a transverse bar 10, while the outer shell 2 projects beyond the padding 2' along the protrusions 6 from the segment 4 and is guided by notches formed in the segment 3. These notches may be located at the transverse bar 10 or along the protrusions from the segment 3. The ends of the protrusions 6 from the segment 4 are advantageously provided with stops 32 or are connected to each other by a transverse bar 11, thus preventing disengagement of the sliding connection 31.

Figure 26:
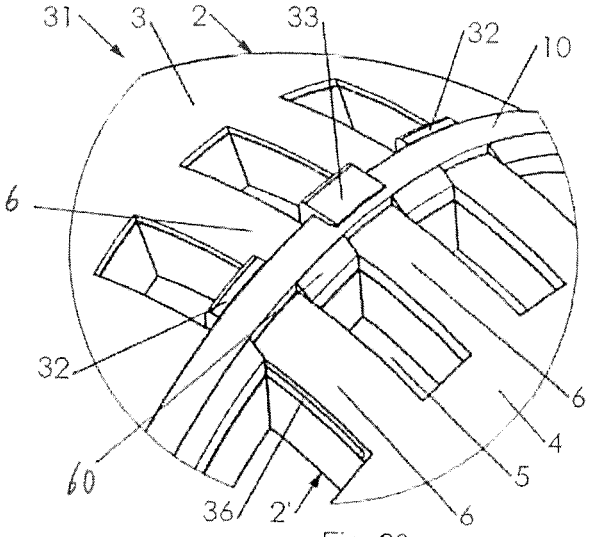
Figure 27:
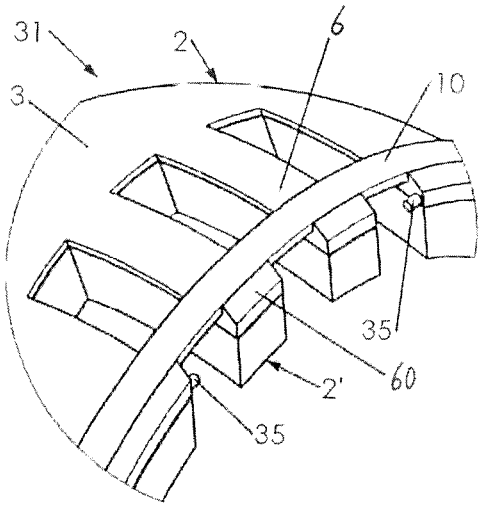
Figure 28:
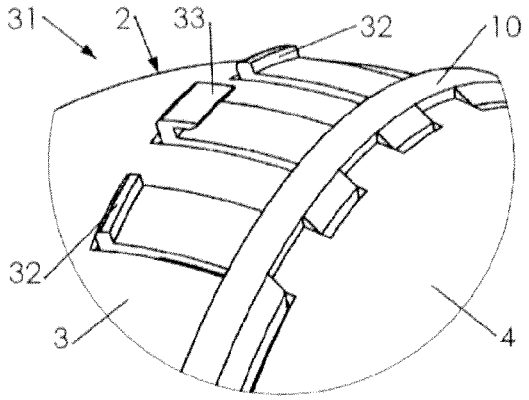

According to another variant shown in FIGS. 26 to 28, one or several protrusions 6 from the segment 4 are provided with a groove 36 inside which a stud 35 fixed to the segment can slide. A stop 32 may be formed at the end of each protrusion 6 provided with a groove It. The other protrusions from the segment 4 are advantageously provided with a tab 33 that engages onto the transverse bar 10 in the extended position located set back from the ends 60 of the protrusions 6.

The number of stops 32, slats 29, tabs 33 or any other appropriate means replacing the transverse her 11 may then vary depending on the embodiment.

FIGS. 29 to 32 show another variant in which two shells 37 and 38 are at least partially above the protrusions 6 and the indentations 5 on the two segments 3 and 4. The shell 38, in this case fixed to the transverse bar 11, covers the segment 4; defines an inner space between itself and the segment 4 that is adapted to guide displacement of the transverse bar 10. A second shell 37 covers the segment 3 and defines an inner space between itself and the segment 3, that is adapted to guide displacement of the assembly composed of the shell 38 and the transverse bar 11.

Figure 29:
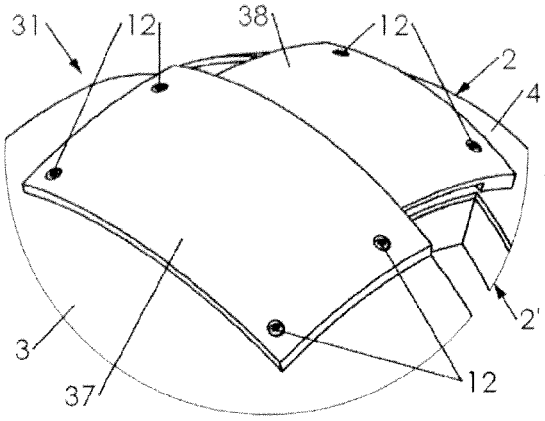
Figure 30:
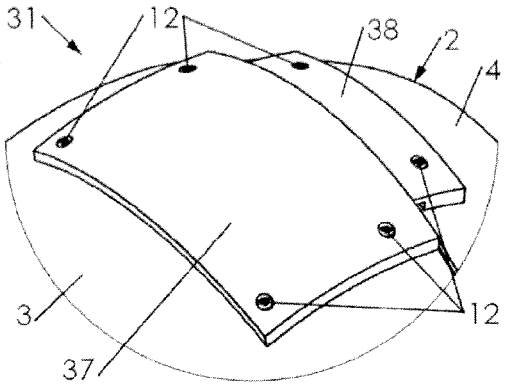
Figure 31:
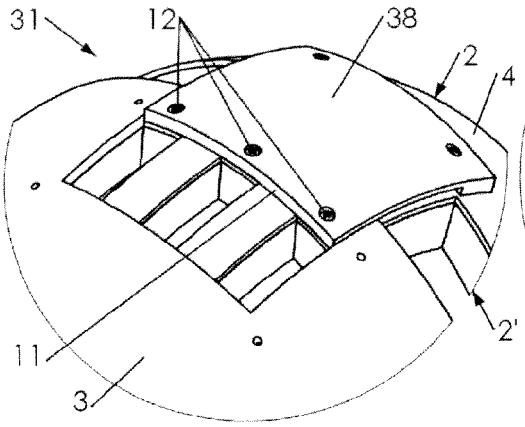
Figure 32:
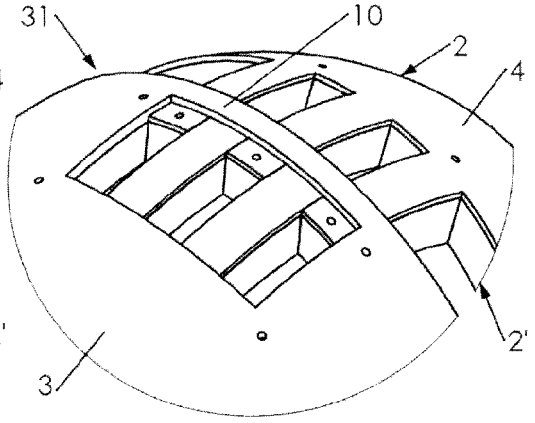

The segments 3 and 4 are shown in the extended position in FIG. 29 and in the folded position in FIG. 30. FIG. 31 is similar to the view in FIG. 29 but the shell 37 is not shown. FIG. 32 is similar to FIG. 29 but the shells 37 and 38 are not shown.

As a variant, only one of the two segments 3 or 4 may be fitted with a shell 37 or 38.

This sliding connection 31 has advantages in the protective helmet application; in particular, it can prevent accidental separation of segments due to the stops, and it forms a rigid assembly. It may also be used to adapt the size and shape of the helmet to the user's head.

In the same way as for the hinge connections described above, it will be seen that the different variants of sliding connections shown are made directly by the structural elements of the helmet 1, and more particularly by the outer shell, thus making this helmet 1 stronger than when the connect ng means are added onto the helmet.

It will easily be understood that other embodiments are possible.

Figure 1:
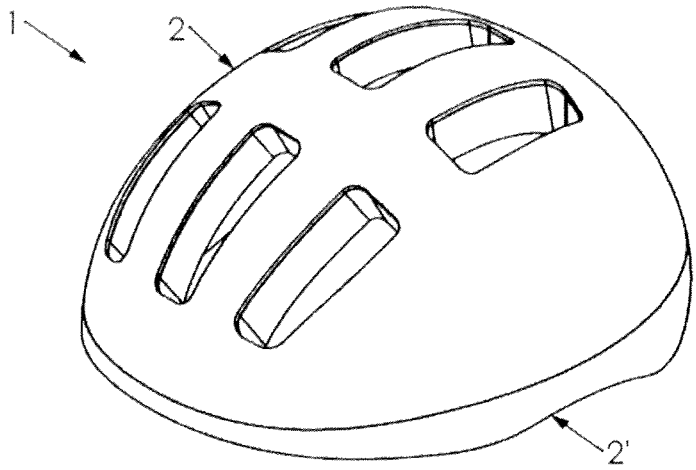
FIG. 1 shows an overview of a protective helmet, like that described above.

Outer Shell Attachment:

As mentioned above and described in FIG. 1, a protective helmet 1 is usually composed of an outer shell 2 and a padding 2'.

The outer shell 2 and the padding 2' may be made separately and then fixed to each other by gluing or by means of an adhesive.

Another "in-mould" technique consists of making the shell 2 and then placing it inside a mould to inject a material, typically polystyrene balls, that will form the padding 2' after expansion and setting. This method allows the padding 2' to perfectly match the shape of the outer shell 2 and give better bond between the two parts.

In the case of an outer shell 2 made from several segments, the material used to make the padding 2' is injected individually for each segment.

It may be advantageous to embed some parts of the outer shell 2 into the foam of the padding 2' in order to make the assembly stronger.

FIGS. 33 to 43 show a detailed view of the outer shell and the padding.

The outer shell 2 has an attachment element in the form of a raised portion or a protuberance from the outer shell 2, with a fold.

The attachment element defines an internal volume adapted to cooperate with the material of the padding 2' at the time of the injection.

More precisely, the attachment element will be embedded in the padding 2', thus making the link between the attachment element and the padding 2'. The "in-mould" technique will help to make a single padding 2' for each segment of the outer shell 2, these different segments can then be connected to each other by connection means like those described in this text.

Figure 33:
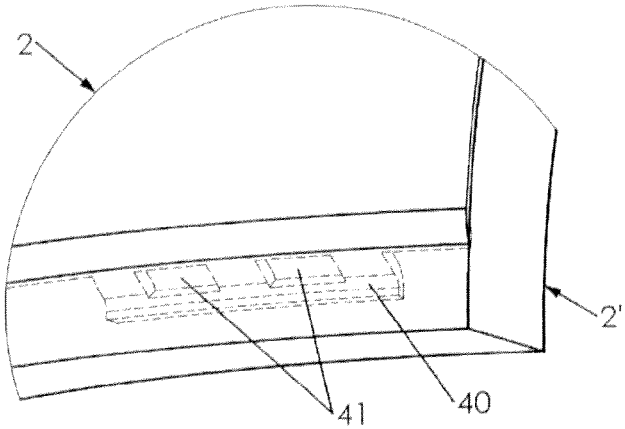
FIGS. 33 and 34 show a fixing device for the padding and the outer shell.
Figure 34:
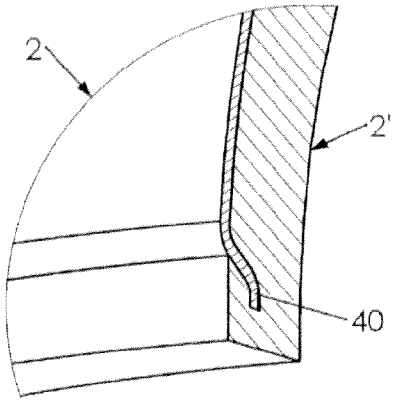

FIGS. 33 and 34 show an embodiment in which a protuberance 40 with a fold at one end and preferably comprising openings 41 is embedded in the padding 2'.

The fold and the openings make the link between the outer shell and the padding 2'.

Figure 35:
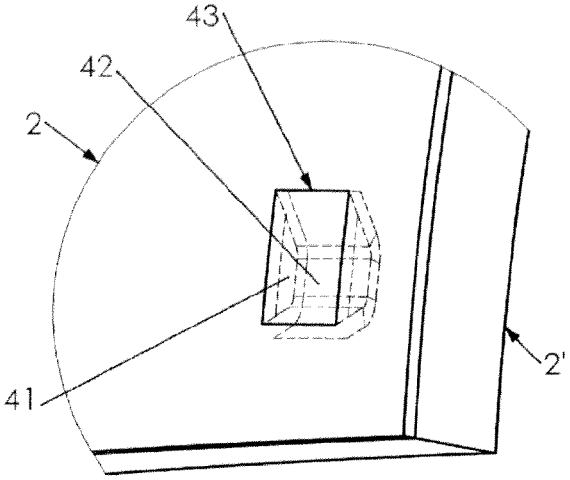
FIGS. 35 to 43 show other embodiments of fixing devices for the padding and the outer shell.
Figure 36:
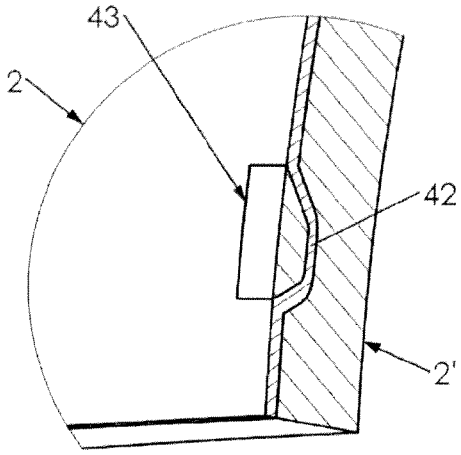

FIGS. 35 and 36 show another embodiment in which a raised portion 42 of the outer shell 2 defining an inner space is embedded in the padding 2'. The raised portion 42 in this case comprises two openings 41 assuring continuity of the material from which the padding 2' is made. The outer shell 2 is also provided with an optional orifice 43 located facing the raised portion, that will facilitate manufacturing of the outer shell 2.

Figure 37:
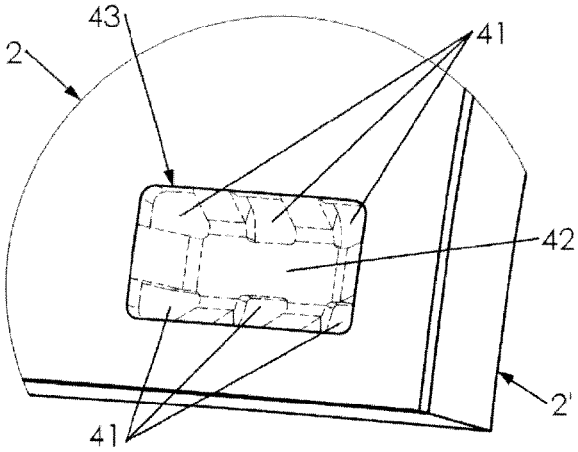
Figure 38:
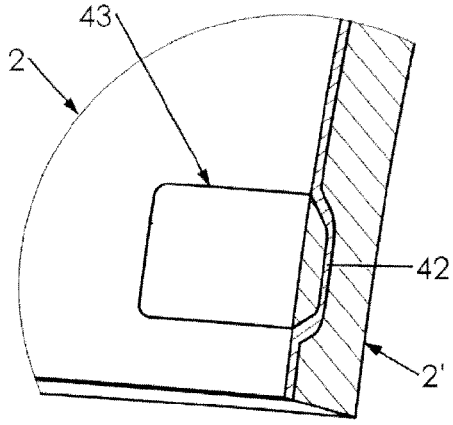

FIGS. 37 and 38 show another variant in which the raised portion 42 is provided with a larger number of openings 41.

Figure 39:
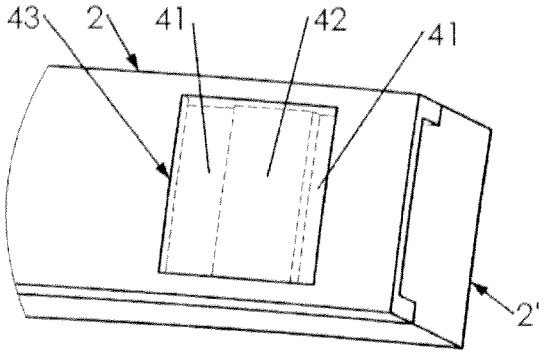
Figure 40:
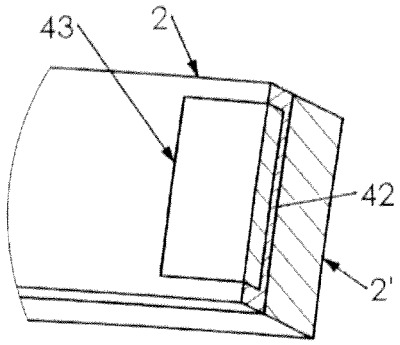

FIGS. 39 and 40 show a variant of the embodiment in FIG. 35 in which the edges of the raised portion 42 are connected to the outer shell 2.

Figure 41:
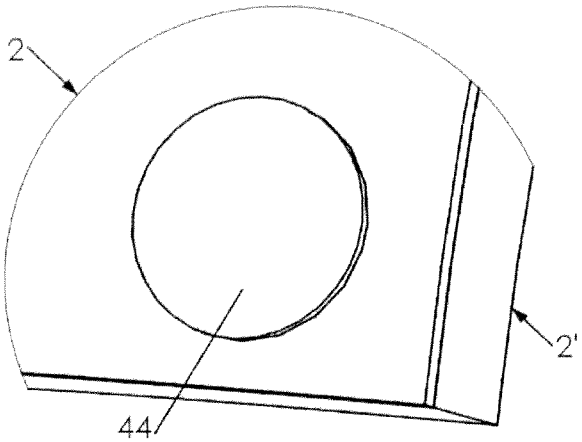
Figure 42:
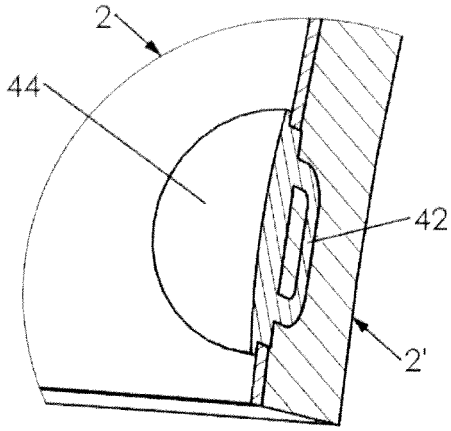
Figure 43:
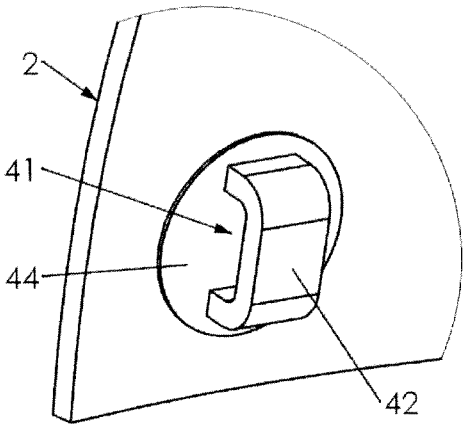

According to another variant shown in FIGS. 41 to 43, the raised portion 42 is fixed to a cap 44 that engages in the orifice formed in the outer shell 2. The raised portion 42 may be provided with at least one opening 41. FIG. 43 is a view of the inside of the helmet on which the padding 2' is not shown.

The cap 44 may form an integral part of the outer shell 2.

Obviously, the shape of the protuberance or the raised portion and the number of openings 41 formed in these attachment elements 40, 42 can vary.

The advantage of these different embodiments is that the outer shell 2 can be made without any complex tooling, despite the presence of protuberances and/or raised portions.

Locking Device:

FIGS. 44, 45, 46, 47 and 48 show a locking device 13 that can be used in a protective helmet 1.

Figure 44:
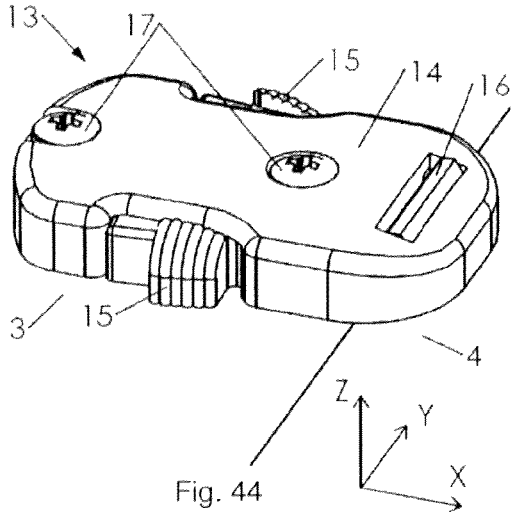
FIGS. 44, 45, 46, 47 and 48 show a locking device that can be used particularly in a protective helmet.

FIG. 44 shows the locking device 13 mounted on the segments 3 and 4 of the protective helmet 1, typically on the outer shell 2.

Figure 45:
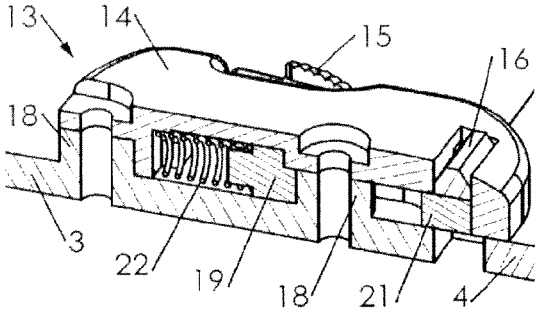

FIG. 45 is a sectional view of FIG. 44.

Figure 46:
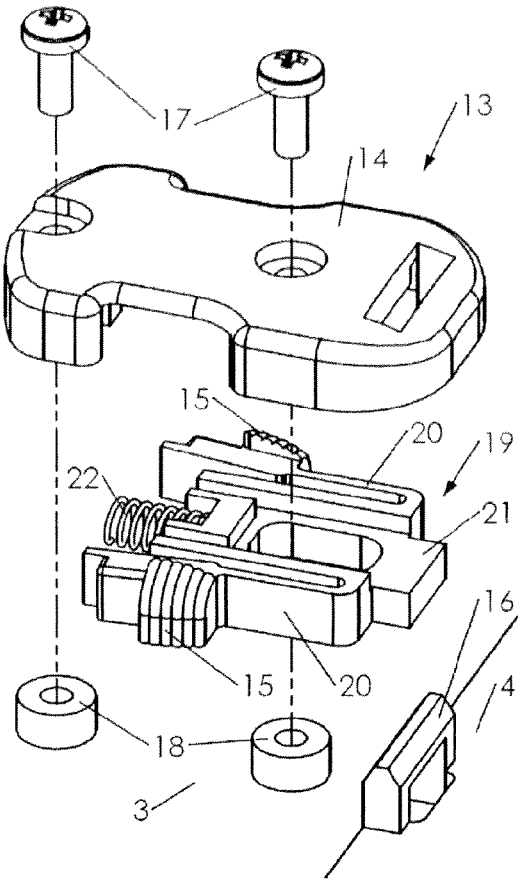

FIG. 46 shows an exploded view of the same locking device 3.

Figure 47:
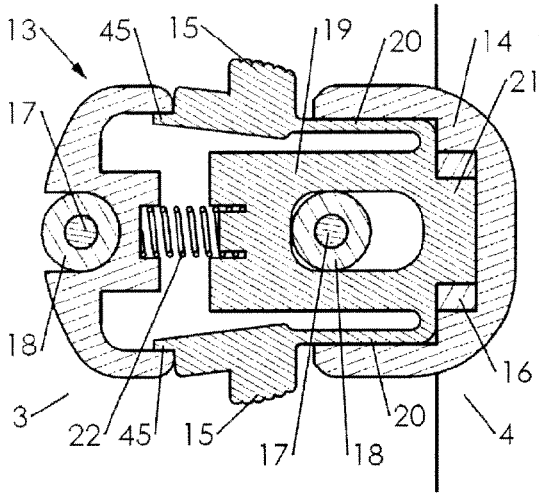
Figure 48:
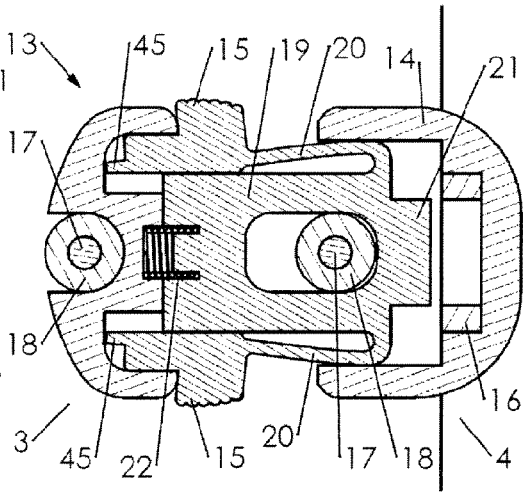
Figure 49:
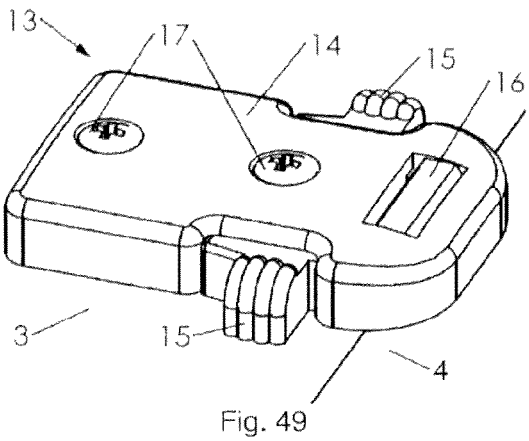
FIGS. 49 to 95 show other embodiments of the locking device.
Figure 50:
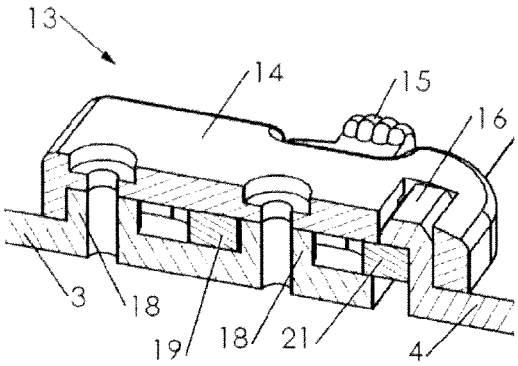
Figure 51:
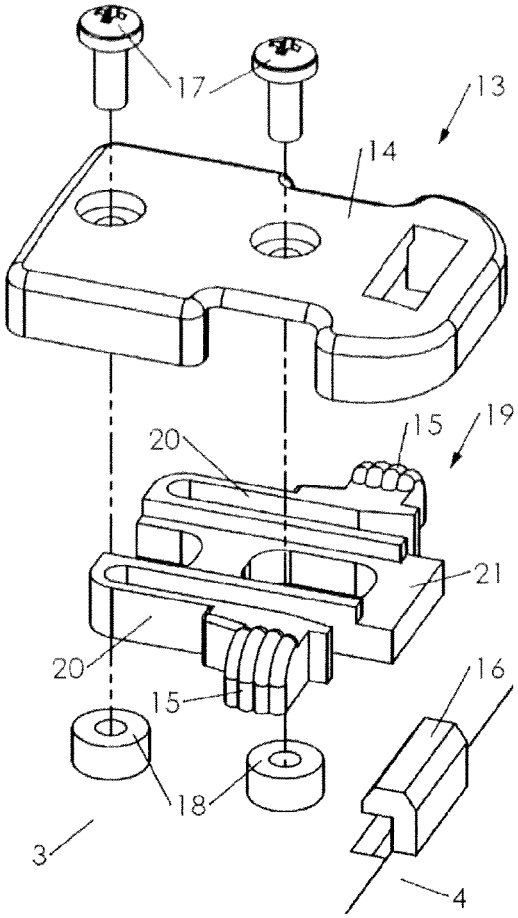
Figure 52:
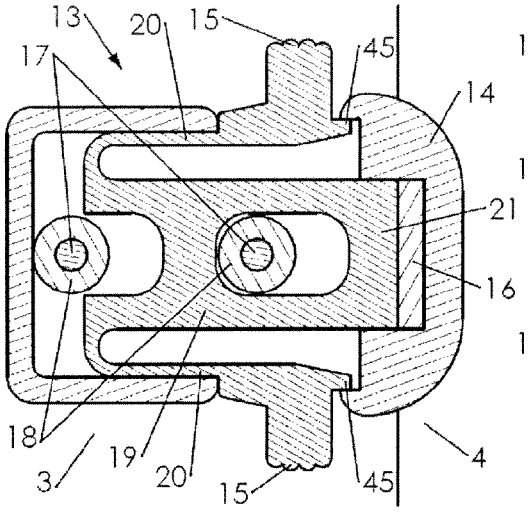
Figure 53:
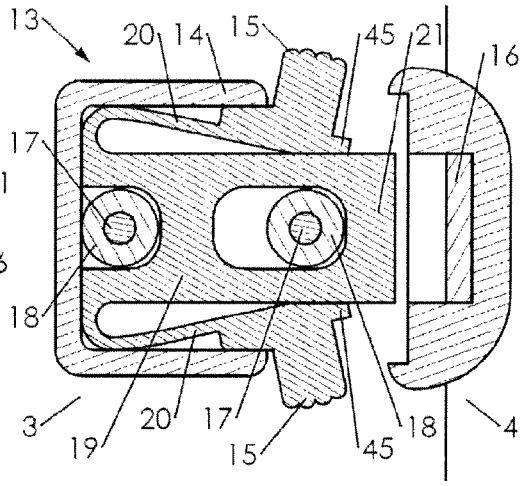
Figure 54:
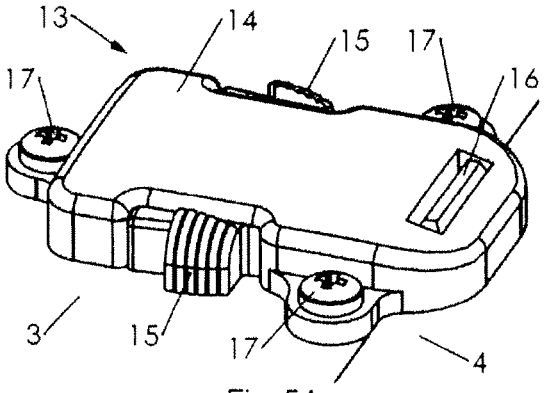
Figure 55:
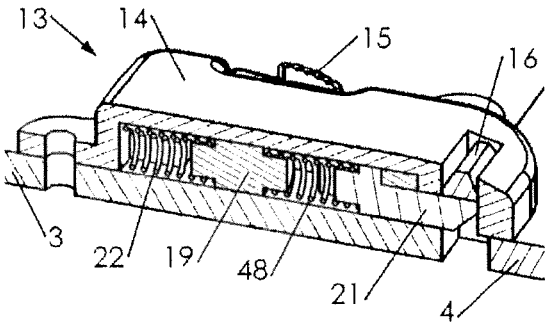
Figure 56:
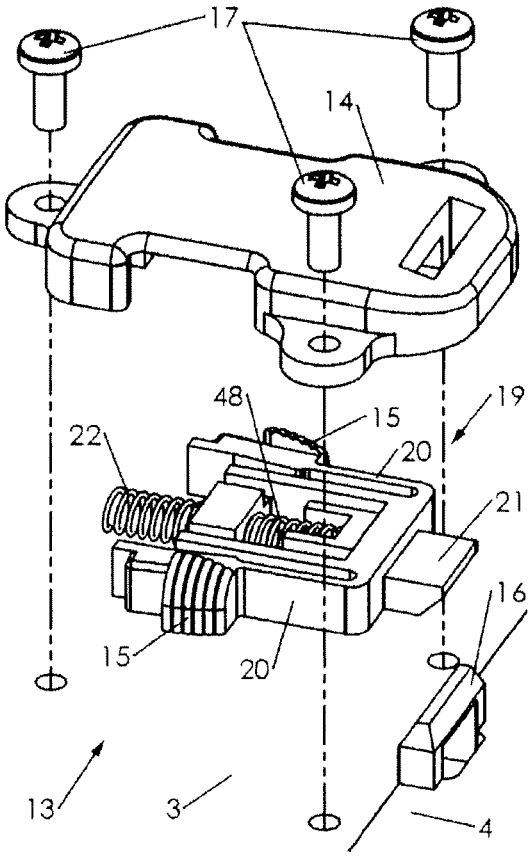
Figure 57:
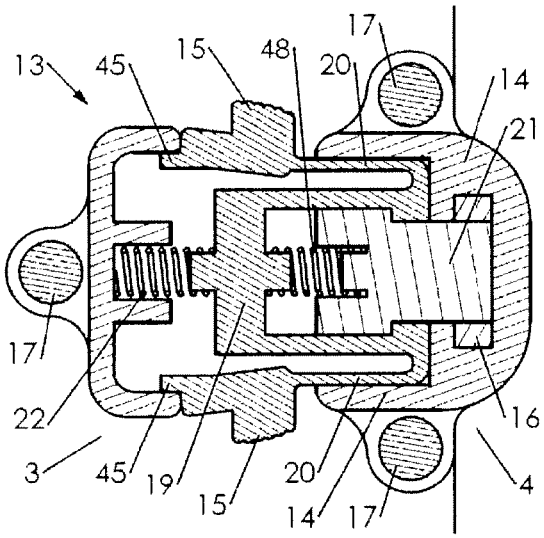
Figure 58:
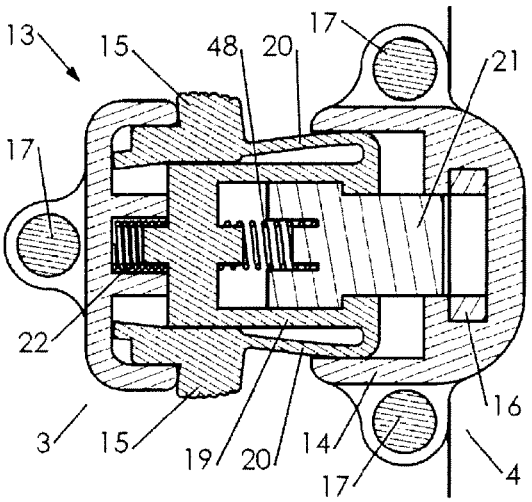
Figure 59:
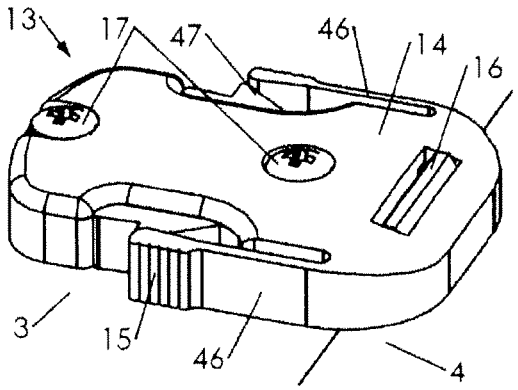
Figure 60:
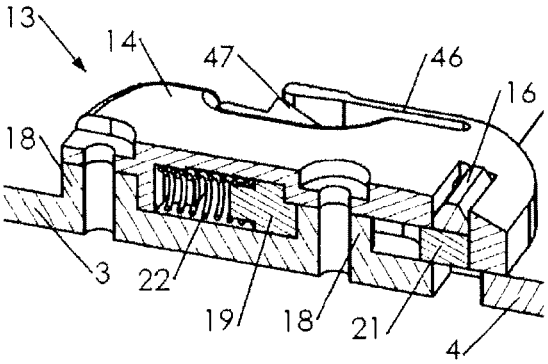
Figure 61:
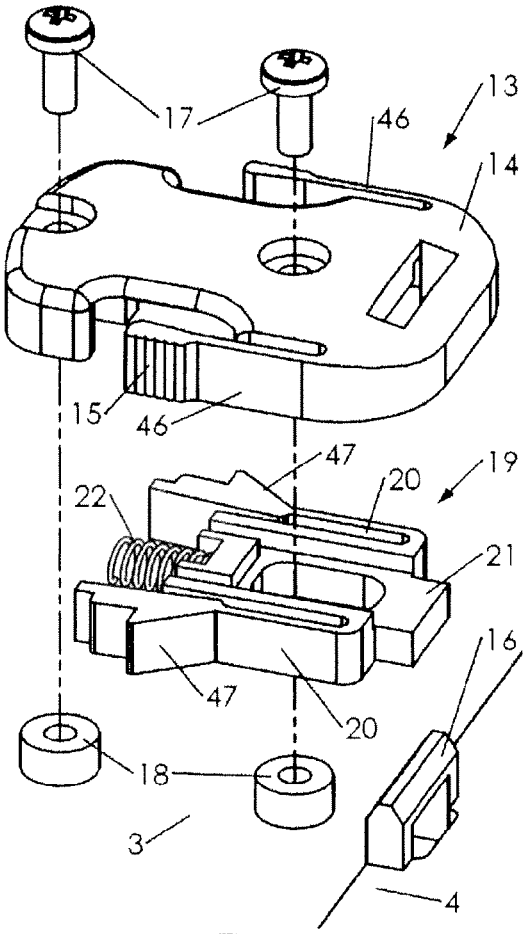
Figure 62:
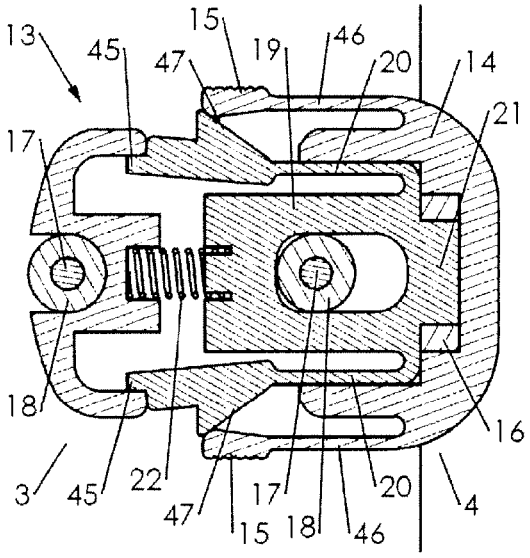
Figure 63:
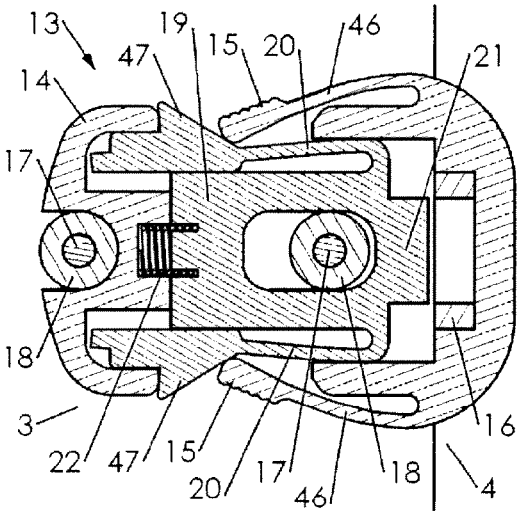
Figure 64:
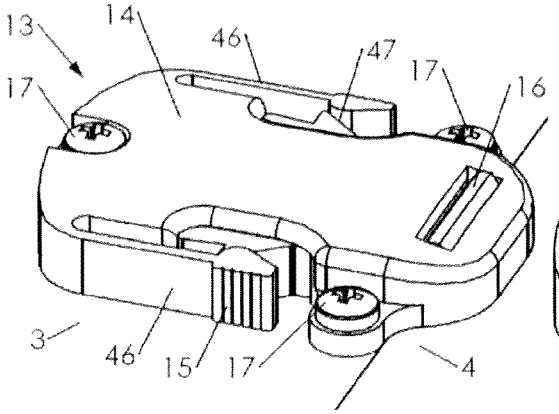
Figure 65:
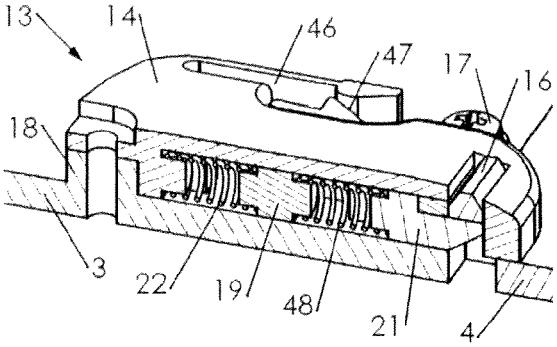
Figure 66:
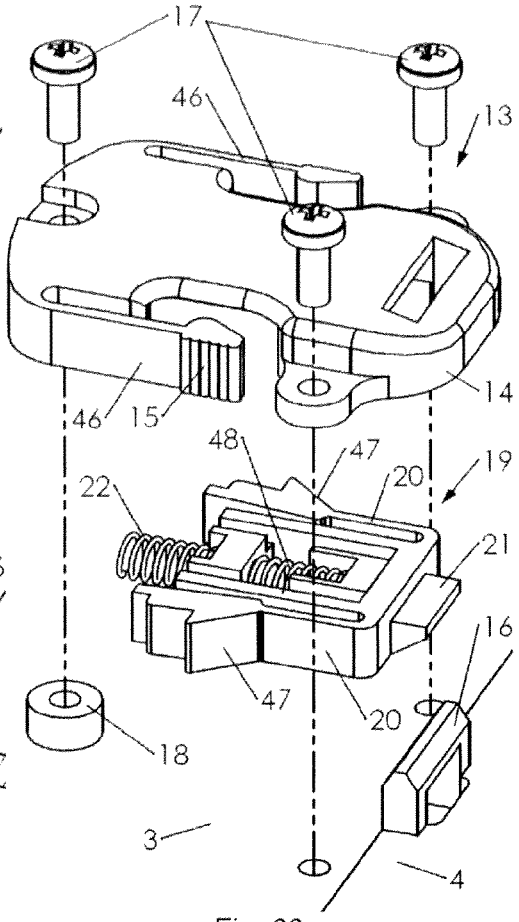
Figure 67:
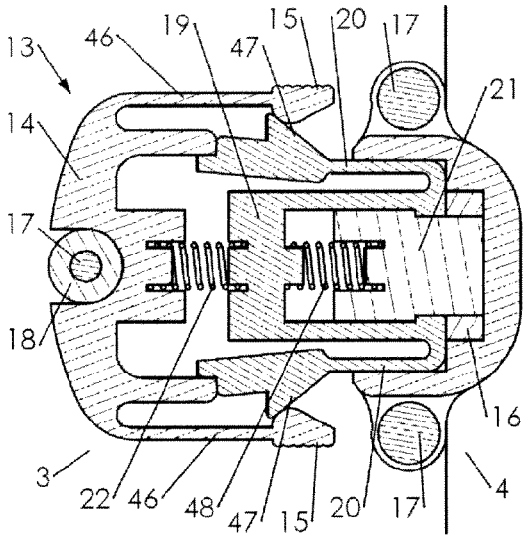
Figure 68:
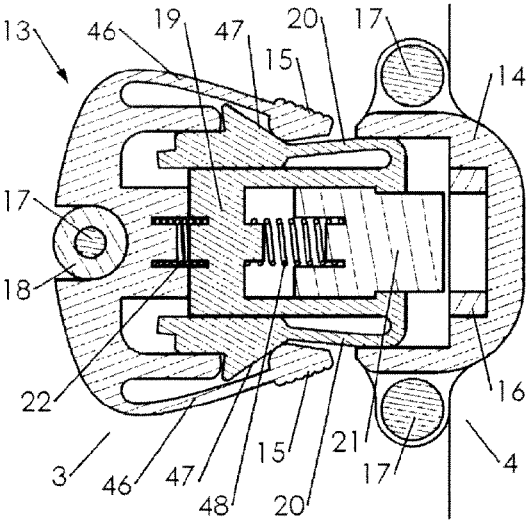
Figure 69:
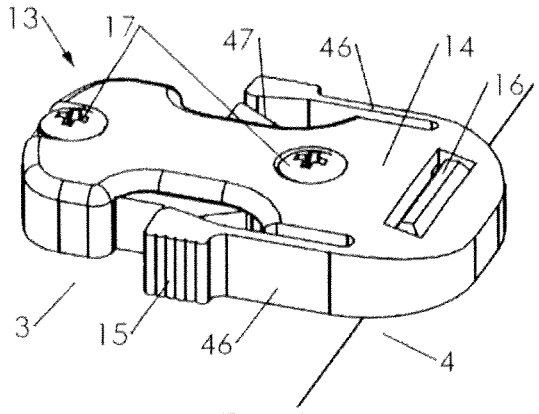
Figure 70:
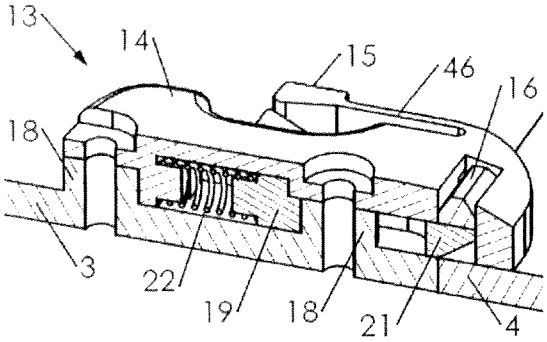
Figure 71:
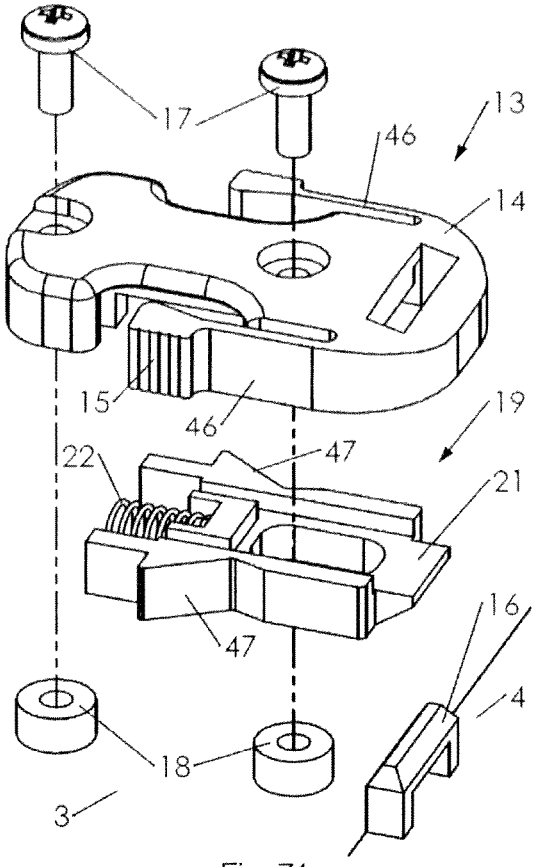
Figure 72:
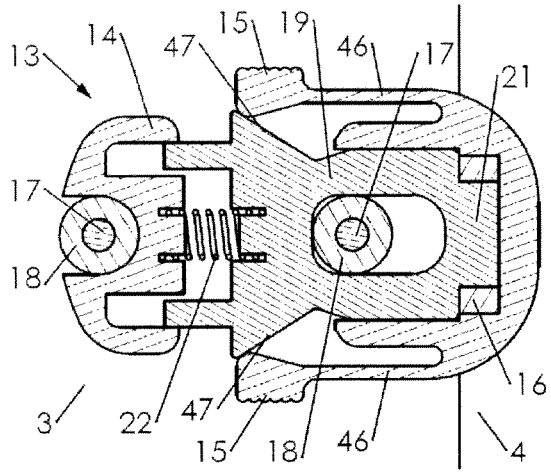
Figure 73:
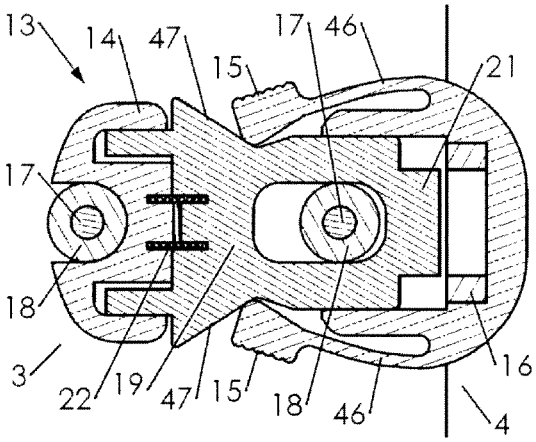
Figure 74:
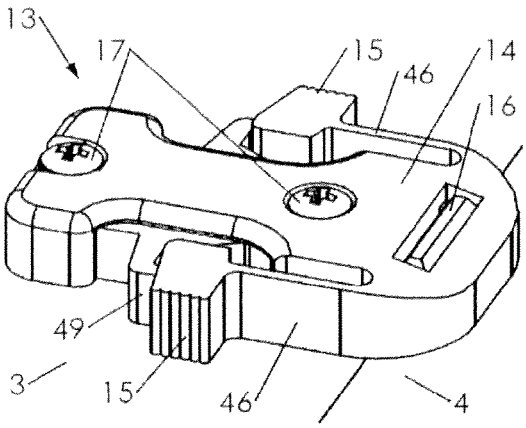
Figure 75:
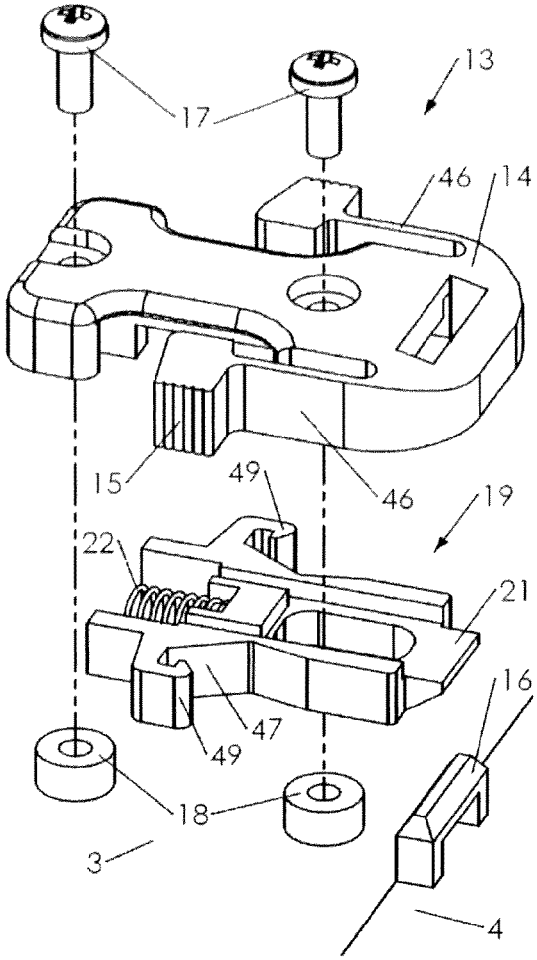
Figure 76:
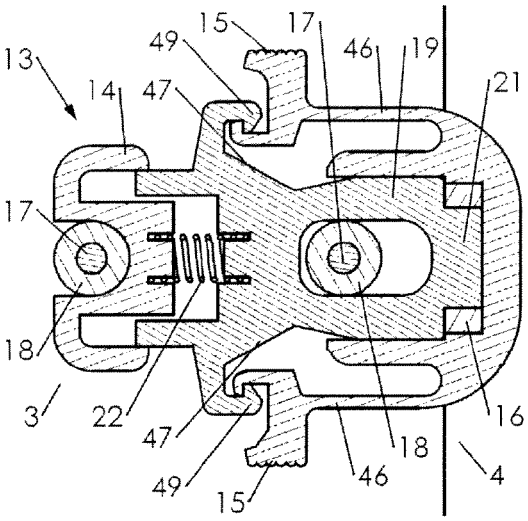
Figure 77:
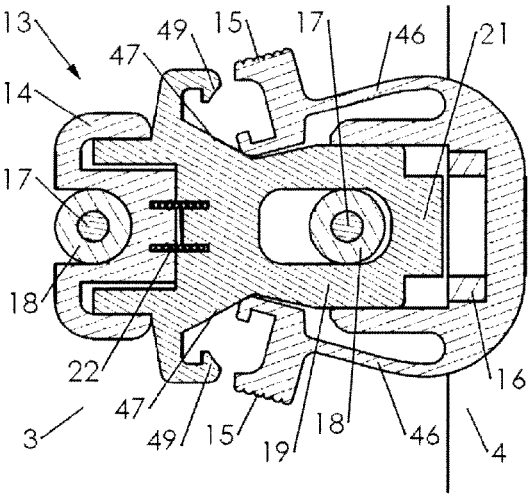
Figure 78:
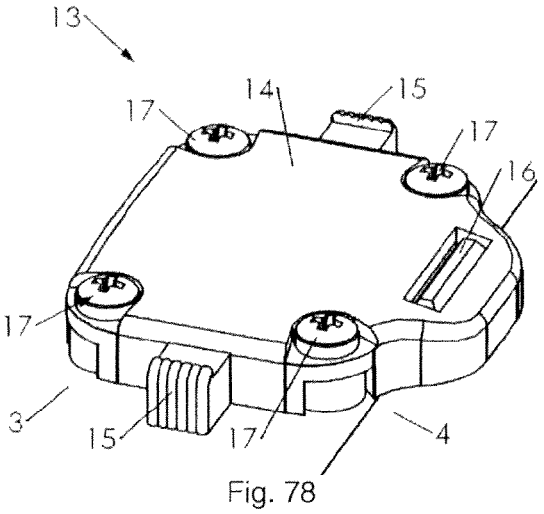
Figure 79:
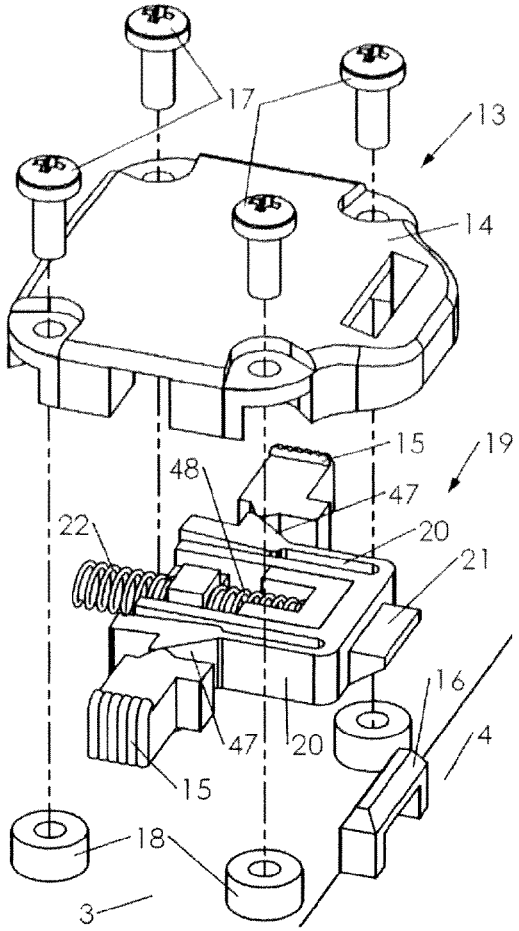
Figure 80:
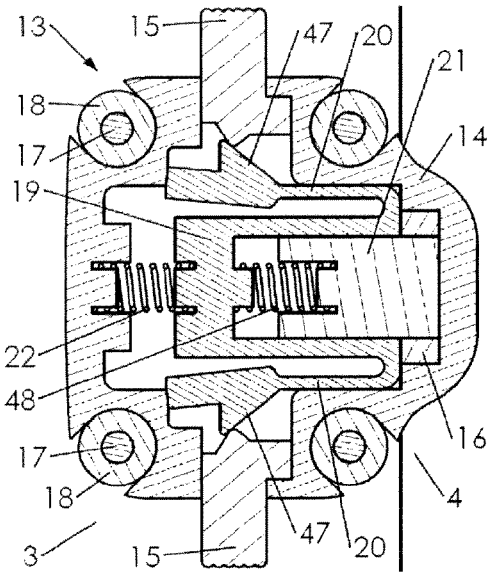
Figure 81:
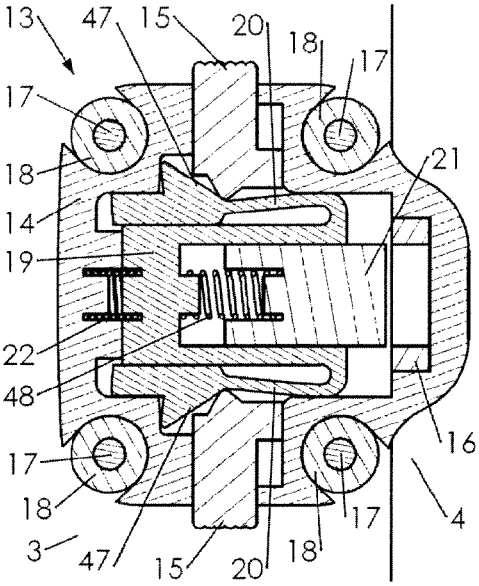
Figure 82:
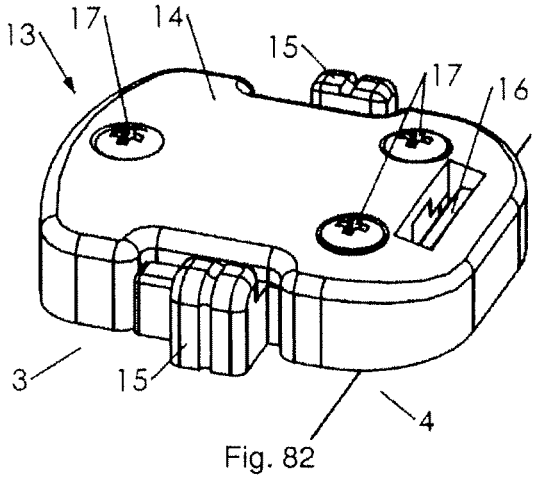
Figure 83:
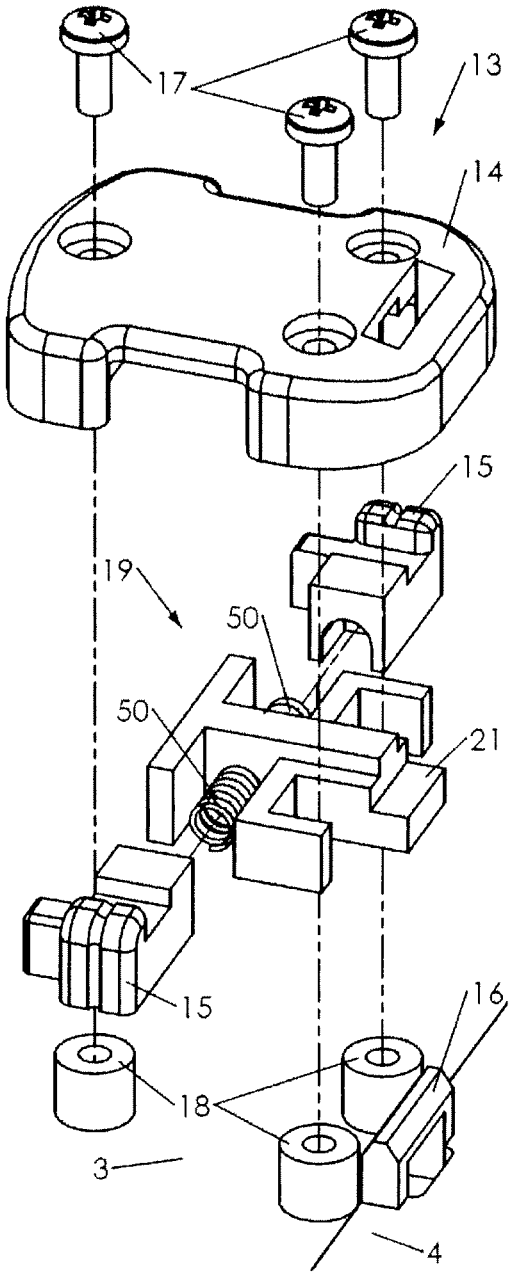
Figure 84:
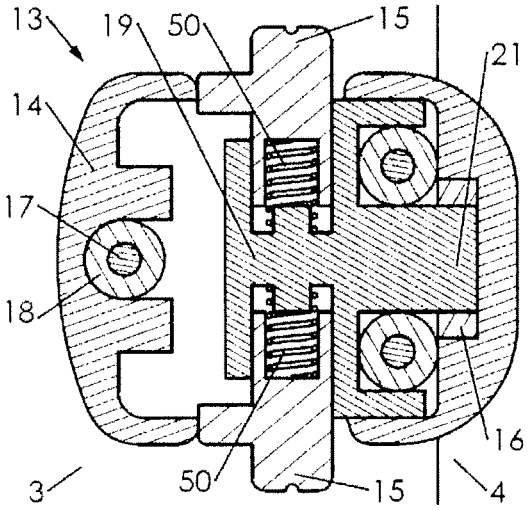
Figure 85:
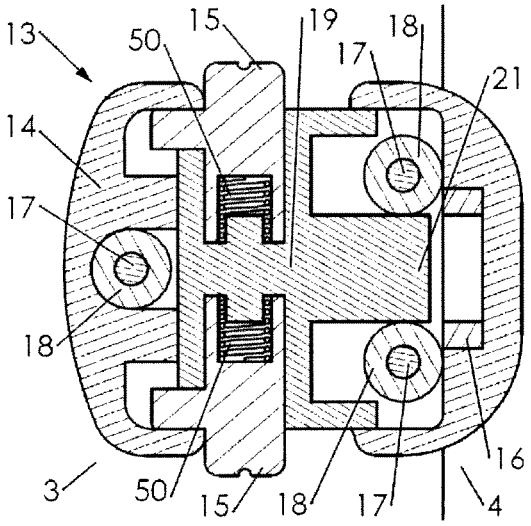

FIGS. 47 and 48 show it sectional views of the same locking device 13, in the locked position and unlocked position respectively.

The locking device 13 shown is located for example at the junction between two segments 3 and 4 of the protective helmet 1.

The locking device 13 comprises a housing 14, pushers 15, a locking tab 16 defining an internal space delimited by the locking tab 16 and the segment 4 of the protective helmet 1, and attachment means 17 that are screws in the embodiment shown.

In the embodiment shown in FIGS. 44 to 48, all the elements making up the locking device 13 except for the locking tab 16, are arranged on a first segment 3, while the locking tab 16 is arranged on a second segment 4. The locking tab 16 may form an integral part of the segment 4 or it may be added on and fixed to it.

The attachment means 17 are housed in raised portions 18 of the first segment 3, said raised portions comprising a central cavity in which the attachment means 17 will fit.

Obviously, the number and arrangement of the attachment means 17 and raised portions 18 can vary depending on the embodiment. Many other variants are possible. The raised portions 18 may for example be located on the housing 14, thus inversing the direction of the attachment means 17. The segment 3 may also be deprived of any raised portions 18, the housing 14 then being fixed directly to the segment 3. The housing 14 may also be fixed by other means such as crimping, riveting, gluing, click fitting or welding. The housing 14 may also be fixed onto an intermediate lid, thus making the locking device 13 independent of its support in this case the segment 3). The junction between the housing 14 and said lid or segment 3 may be located in another area, for example on the side opposite the locking tab 16. Instead of being part of the segment 3 or 4 on which they are fixed, the housing and/or the locking tab may be retained by a flexible material for example such as a strap.

A latch 19 slides inside the housing 14 and comprises a sliding bolt 21 with a shape complementary the internal space defined by the locking tab 16. The elastic arms 20 are fitted with pushers 15 and are connected to the body of the latch 19 on the side of the sliding bolt 21.

According to another variant shown in FIGS. 49 to 53, the elastic arms 20 are connected to the body of the latch 19 on the side opposite the sliding bolt.

In the embodiment shown in FIGS. 44 to 48, the latch 19 is guided transversely, in other words along the Y axis, by two guide grooves arranged longitudinally joining together at the centre of the body of the latch 19 on the side of the sliding bolt and that will cooperate with the internal wall of the housing 14. The number of grooves can vary; for example in FIG. 51, the latch 19 only has a single groove. The grooves may also be located on the housing 14, on the segment 3 or on the latch at the junction with the segment 3, the facing part then having a complementary shape.

FIGS. 47 and 48 show top sectional views of the locking device 13, in the rocked position in which the segments 3 and 4 are held in a fixed position relative to each other, and in the unlocked position in which relative movement between segments 3 and 4 is possible, respectively.

In the locked position, the sliding bolt 21 is housed in the internal space defined by the locking tab 16. The pushers 15 then project outside the housing 14 and the elastic arms 20 are at rest, in other words they are not deformed or are only slightly stressed, the elastic arms 20 hold the locking device in the locked position, due to an appropriate shape of the housing 14. More precisely, part of the external face of the elastic arm 20, the surface of which is perpendicular to or oblique to the sliding direction of the latch 19, comes into contact with the edge of the lateral opening formed in the housing 14. The end of the elastic arm 20 may be fitted with a stud 45 that comes into contact with the internal face of the wall of the housing 14, to limit the outwards displacement of the elastic arm 20 in the locked position.

In the embodiment shown in FIGS. 44 to 48, the optional elastic means 22, in this case a spring, applies a force along the X direction to the latch 19, by applying a return force on it. Therefore, there is only one stable position, which is the locked position.

The spring can be replaced by a protrusion that deforms elastically and is located on the latch, the housing or the segment 3.

If there is no optional elastic means 22, the latch in has two stable positions, one corresponding to the locked position and the other corresponding to the unlocked position. Therefore, the latch 19 has to be made to slide using two pushers 15 to lock the device.

Such an embodiment is shown in FIGS. 49 to 53.

Instead of being parallel to the displacement direction of the latch 19, the internal walls of the housing 14 in contact with the outer face of the elastic arms 20 may be oblique, thus facilitating translation of the latch 19.

Figure 86:
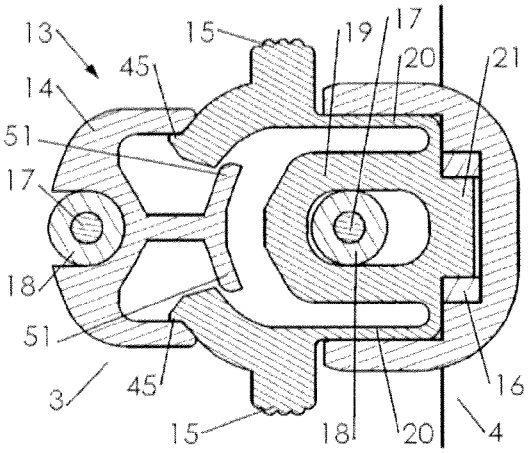
Figure 87:
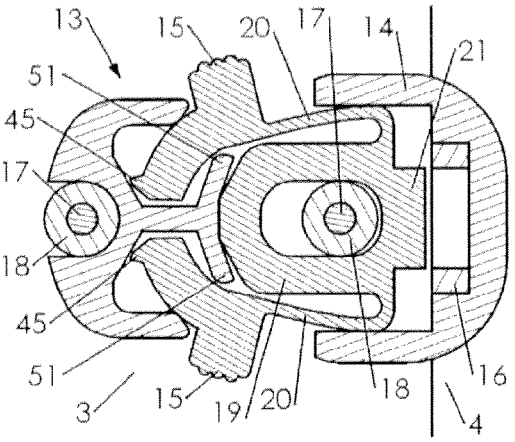

FIGS. 86 and 87 show another embodiment that does not comprise an elastic means 22, in which the outer faces of the elastic arms 20 cooperate with the housing 14 to hold the latch 19 in a stable position, the locked position. The locking device 13 may also comprise pins 51, that due to an adapted shape of the inner face of the elastic arm 20, facilitate displacement of the latch 19 in the unlocking direction when the user applies pressure on the pushers 15.

Locking is done by the sliding bolt 21 and by the housing 14. The housing 14 surrounds the locking tab 16 and thus limits relative movement of segments 3 and 4 along the X and Y axes shown in FIG. 44, while the sliding bolt 21 limits the movement along the Z axis defined in FIG. 44.

The sliding bolt 21 and the locking tab 16 may be bevelled or may be provided with several rounded edges in order to facilitate insertion into the locking tab 16 and the housing 14 is respectively.

The locking tab 16 is inserted into the housing 14 upwards along the 7, direction from the bottom, but it could also be inserted in the opposite direction.

Other embodiments may involve locking in a different direction. The disclosed embodiment can be used to assemble segments 3 and 4 by a relative movement along the Z axis. However, other assembly methods may prove to be desirable; for example to enable assembly by relative movement of segments 3 and along the X axis. The locking tab 16 could then be in the form of a hook, defining at least one groove, inside which a protrusion is housed, for example that could to located at the end of an elastic arm 20, or one several rigid arms mounted free to pivot and provided with elastic means such as springs.

The unlocked position is obtained by applying simultaneous pressure on the two pushers 15, and then sliding the latch 19 to release the sliding bolt 21 from the inner space defined by the locking tab 16. The two segments 3 and 4 can then be moved relative to each other along the Z axis. The elastic arms 20 are deformed elastically, and they are limited in bending by the body of the latch 19. The stop may also be made by the housing 14 or the segment 3.

The elastic arms 20 may be replaced by rigid arms installed and pivoting on the latch 19 and provided with an elastic device such as a helical spring or a strip that holds said rigid arms towards the outside of the housing 14.

There are many possible variants of this locking device 13; for example, the locking tab 16 could be in the form of a hook as shown in the embodiment illustrated in FIGS. 49 to 53, or it could define several Internal spaces inside which the appropriately shaped sliding bolt 21 is inserted, for example comprising several protrusions complementary to said internal spaces.

The embodiment shown in FIGS. 54 to 58 is u similar to the embodiment in FIGS. 44 to 46, but instead of the sliding bolt 21 being fixed to the Latch 19, it is capable of moving relative to the latch 19. A spring 48 or any other elastic means arranged between the latch 19 and the sliding bolt 21, holds the sliding bolt in position. This embodiment, due to an appropriate shape of the sliding bolt 21 and the locking tab 16, has the advantage that it locks when the locking tab is inserted into the housing without the need to displace the latch 19. Stops are placed between the latch 19 and the sliding bolt 21 such that the sliding bolt 21 follows the displacement of the latch 19 when the latch is moved to release the locking device 13. The locking device 13 does not necessarily have an elastic means 22.

According to another embodiment shown in FIGS. 59 to 63, the housing 14 comprises elastically deformable lips 46, on which pushers 15 are arranged. The elastic arms 20 are then provided with a ramp 47 designed to interact with the lips 46 when the user applies pressure on the pushers 15, and thus cause displacement of the latch 19. The latch 19 is held in a stable position by the elastic means 22.

FIGS. 69 to 73 show an embodiment in which the ramps 47 are rigidly fixed onto the body of the latch 19. The lips 46 interact with the ramps 47 to cause displacement of the latch 19 when the user applies pressure on the pushers 15 arranged on the lips 46. The elastic means 22 holds the latch 19 in a stable position.

The embodiment shown in FIGS. 74 to 77 is similar to the embodiment shown in FIGS. 69 to 73, but the latch 19 is provided with hooks 49 cooperating with the end of the lips 46, reducing the risk of unlocking when the lips 46 are left free.

According to another variant shown in FIGS. 64 to 68, the lips 46 may be connected to the housing 14 on the side opposite to the sliding bolt 21. Furthermore, this embodiment advantageously has a sliding bolt 21 independent of the latch 19 and held in position by a spring 48.

The elastically deformable lips 46 may be replaced by rigid lips mounted free to pivot on the housing 14 and provided with an elastic element, preferably a spring.

FIGS. 78 to 81 show an embodiment similar to that shown in FIGS. 64 to 68, but in which the housing 14 does not have any lips 46 and in which the two pushers 15 are independent of the housing 14; they are free to slide transversely, in other words along the Y axis and are retained near the outside of the housing 14 by the elastic arms 20. The pushers 15 are designed to interact with the ramps 47 of the elastic arms 20 and thus cause displacement of the latch 19 when the user applies pressure on said pushers 15. As a variant, the sliding bolt 21 may be fixed to the latch 19.

According to another variant shown in FIGS. 82 to 85, the two pushers 15 are independent; they are free to slide transversely, in other word along the Y axis, relative to the latch 19 and are retained near the outside of the housing 14 by an elastic means 50, for example a spring. The pushers 15 hold the locking device 13 in the locked position due to an appropriate shape of the housing 14. This embodiment may be provided with an elastic means 22 and/or a sliding bolt 21 independent of the latch 19 retained by a spring 48 as described above.

According to another embodiment shown in FIGS. 91 to 95, the latch 19 comprises one or several elastically deformable protrusions 52 that are housed in the notches of the housing 14. The user then only makes a translation movement of the latch 19, the pusher 15 then being adapted for such a movement. This variant has two stable positions, namely the locked position and the unlocked position.

Figure 88:
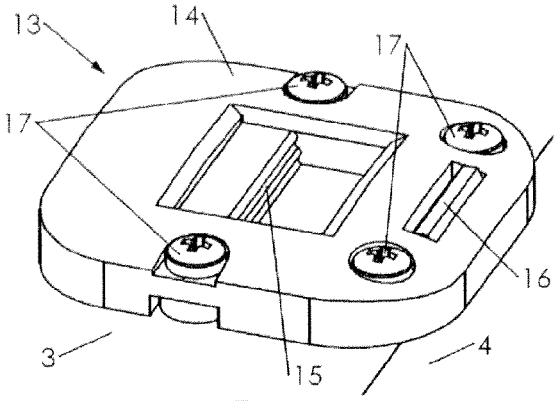
Figure 89:
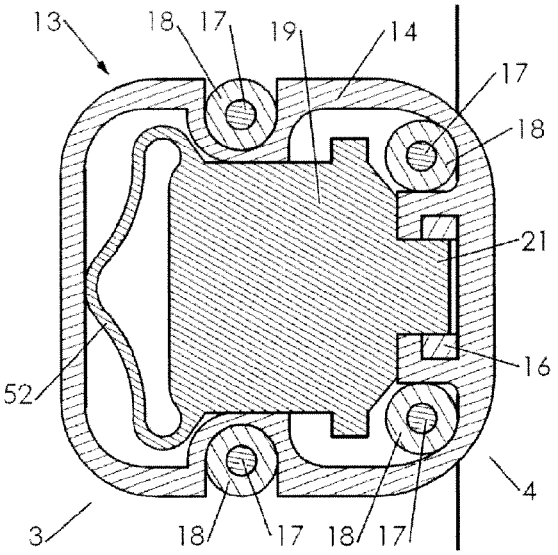
Figure 90:
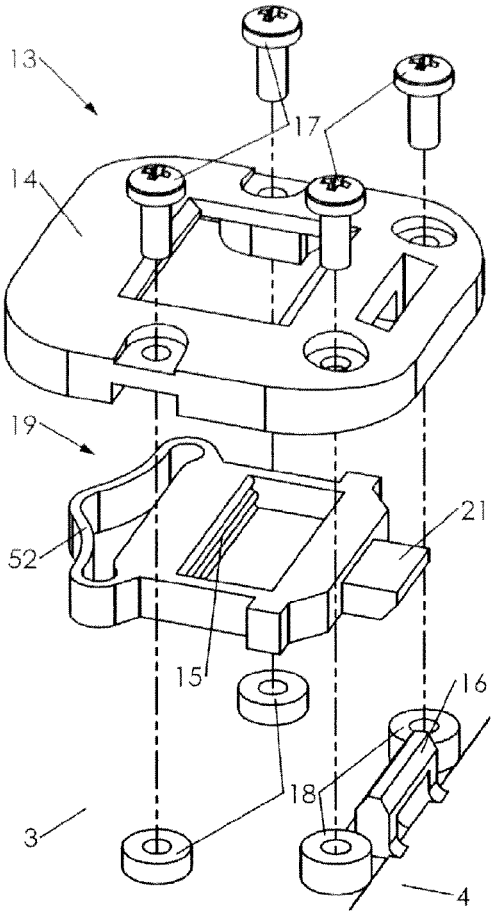
Figure 91:
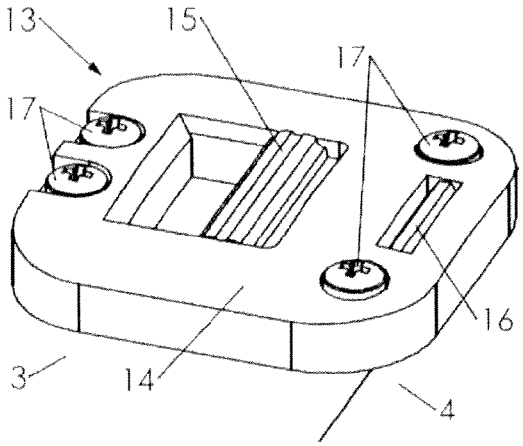
Figure 92:
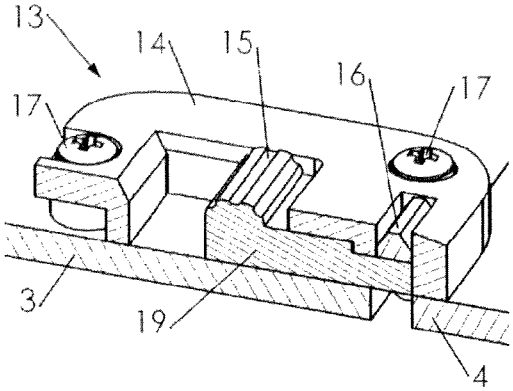
Figure 93:
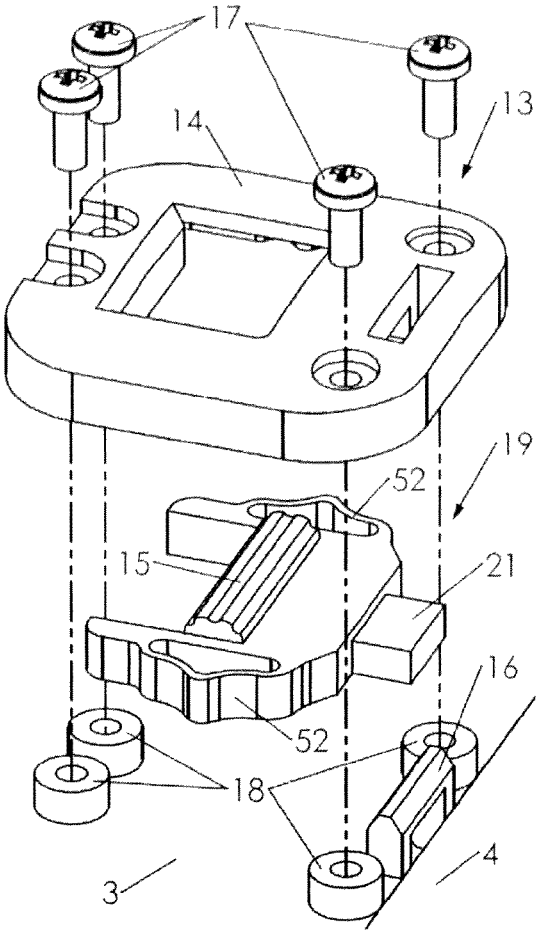
Figure 94:
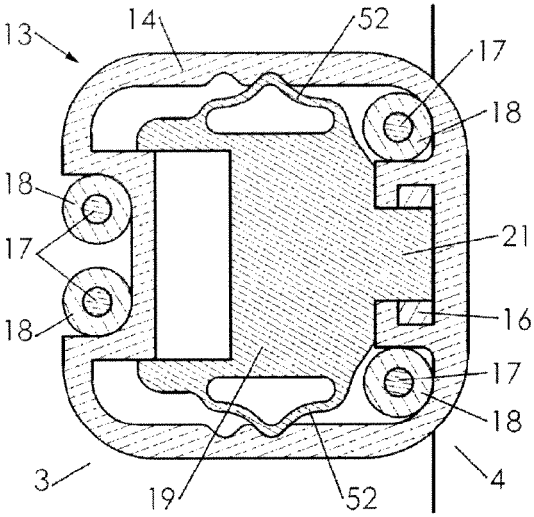
Figure 95:
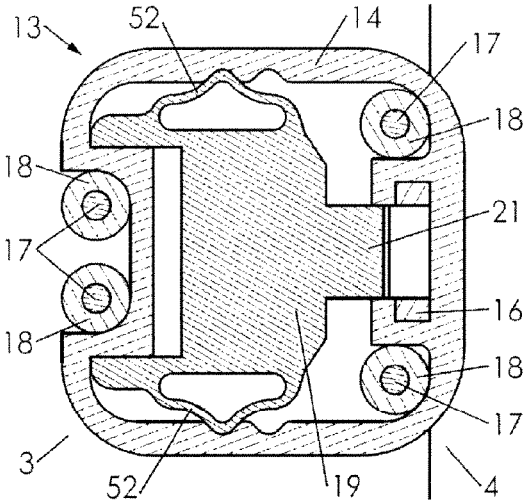

The variant shown in FIGS. 88 to 90 is similar to that in FIGS. 91 to 95 but the elastic protrusion 52 applies a return force holding the latch 19 in the locked position. This embodiment has the advantage of locking itself when the locking tab 16 is inserted into the housing 14 without the user needing to displace the latch 19, due to appropriate shapes of the sliding bolt 21 and the locking tab 16.

The number of elastic protrusions 52 can vary, they may be an integral part of the housing 14 or the segment 3, or they may be replaced by another elastin element, for example a spring type element.

According to another embodiment, the central cavity in the raised portions 18 inside which the attachment means 17 are housed, is oblique relative to the surface of the segment 3, which has advantages during manufacturing of segments.

One possible variant embodiment of the locking device 13 with two pushers 5 could comprise a single pusher 15, locking being done from one side only.

Such a locking device 13 has many advantages, in particular it can procure robust locking of the segments along displacement directions that may vary depending on the chosen embodiment. The user can easily manipulate it, while being sure that locking is secure because the only way to unlock it is to apply simultaneous pressure on the two pushers 15 located on each side of the housing 14 in the case in which the device comprises two pushers 15 arranged on each side of the housing 14.

Furthermore, this locking device 13 can be applied to other domains for example such as sports articles, bags, luggage, child care accessories, and household goods.

In particular, the different embodiments of the locking device 13 may be combined with the different connection types (hinge connection 30 and sliding connection 31) described above.

Protective Helmet Fitted with the Elements Mentioned Above:

A protective helmet 1 provided with the different elements described above, namely at least one hinge connection 30 and/or at least one sliding connection 31, and advantageously at least one locking device 13 would then have advantage in terms of dimensions when not in use.

During use, the protective helmet 1 has a conventional shape; the different segments making up the helmet being held fixed relative to each other by the combination of sliding connections 31 and/or hinges connections 30 and locking devices 13.

The special arrangement of the segments and the hinge connections 30 and/or sliding connections 31 will thus result in a specific kinematic sequence to fold the helmet 1 and thus reduce its size.

FIGS. 96 to 99 show an example of a protective helmet 1 provided with hinge connections 30, sliding connections 31 and locking devices 13 as described above.

Figure 96:
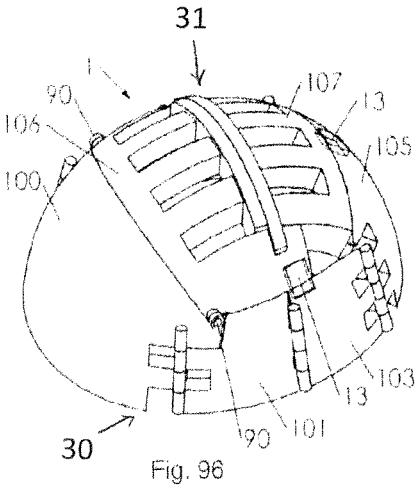
FIGS. 96 to 99 show a foldable protective helmet.
Figure 97:
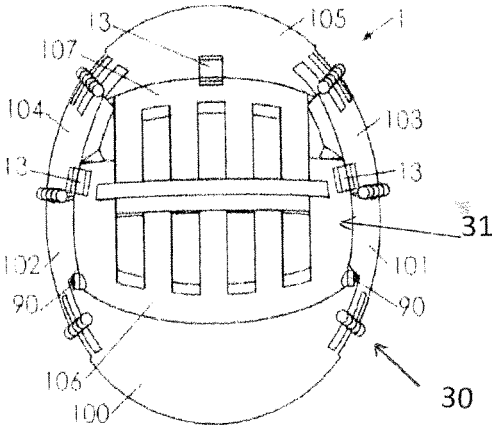
Figure 98:
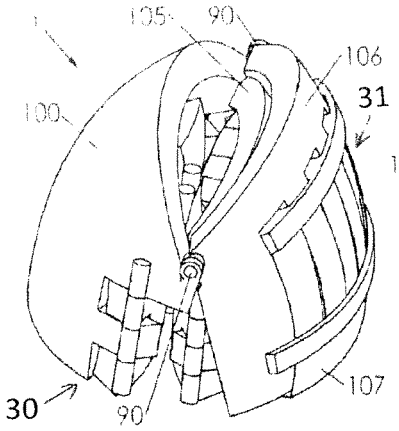
Figure 99:
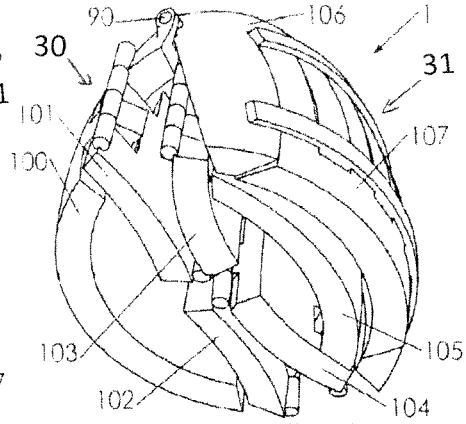

The protective helmet 1 is shown in the usage or extended position in FIGS. 96 and 97, and in the folded position in FIGS. 98 and 99.

The helmet 1 is composed of segments 100, 101, 102, 103, 104, 105, 106 and 107. Peripheral segments 100, 101, 102, 103, 104, 105 are connected in pairs by means of a hinge connection 30. More precisely, a hinge, connection 30 connects segments 100 and 101, segments 101 and 103, segments 3 and 105, segments 105 and 104, segments 104 and 102, and segments 102 and 100 to each other. The central segments 106 and 107 are connected to each other by a sliding connection 31. The segment 106 is connected to segment 100 by means of a pivot connection 90 composed of two hinge points located on each side of the protective helmet 1.

In the extended position, the segments are held fixed relative to each other by three locking devices 13 connecting segments 106 and 103, segments 106 and 104, and segments 107 and 105. It can be seen that a small number of locking devices 13 can hold all fixed segments together; nevertheless the number of locking devices 13 and their position may vary, for example to improve the strength or ergonomics of the helmet 1. Locking devices 13 connecting the segment 106 to segments 103 and 104 may for example be moved to connect segment 106 to segments 101 and 102.

When the helmet is not in use, the user can unlock the locking devices 13 and thus enable displacement of the different segments. The segment 107 engages in segment 106 by means of the sliding connection 31 between these two segments 106 and 107 and through openings in these segments formed by indentations and protrusions that are formed in them. Segments 101, 102, 103, 104 may then be folded down inside the helmet through hinge connections 30 connecting the peripheral segments to each other, such that the segment 105 moves towards the segment 100. The assembly composed of segments 106 and 107 can then pivot about segment 100 through the pivot connection 90, thus covering the segment 105.

The extension operation is done in the reverse order. However, the order in which these operations are done can vary.

The helmet 1 the folded is shown in FIGS. 98 and 99; it can be seen that the helmet is smaller, in this case the space inside the helmet 1 corresponding to the cavity inside which the user's head will fit when in the extended position is very much reduced.

Furthermore, due to the synergy between the locking devices 13, the hinge connections 30 and the sliding connections 1, the user only needs to perform a small number of operations to move from the extended position to the folded position and vice versa.

Such a protective helmet 1 may be used in various applications, particularly for cycle or motorcycle helmets.

Figure 100:
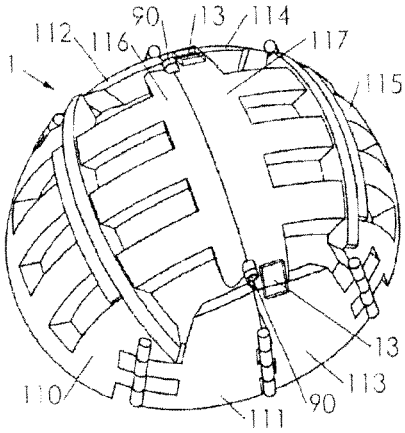
FIGS. 100 to 149 show other embodiments of the foldable protective helmet.
Figure 101:
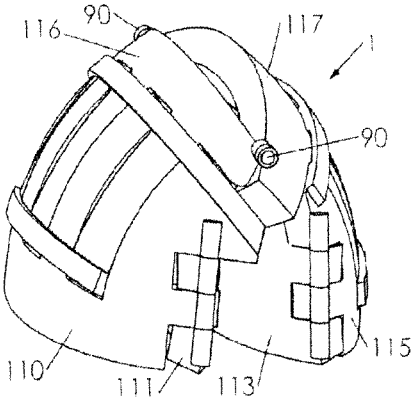

According to another variant shown in FIGS. 100 and 101, the helmet 1 is composed of peripheral segments 110, 111, 112, 113, 114, 115 and central segments 116, 117. The peripheral segments are connected to each other in pairs through a hinge connection 30. Segments 110 and 116, and segments 115 and 117, are connected to each other through a sliding connection 31. Segments 116 and 117 are connected to each other by a pivot connection 90. The helmet also comprises two locking devices 13 connecting segment 117 to segments 113 and 114.

Figure 102:
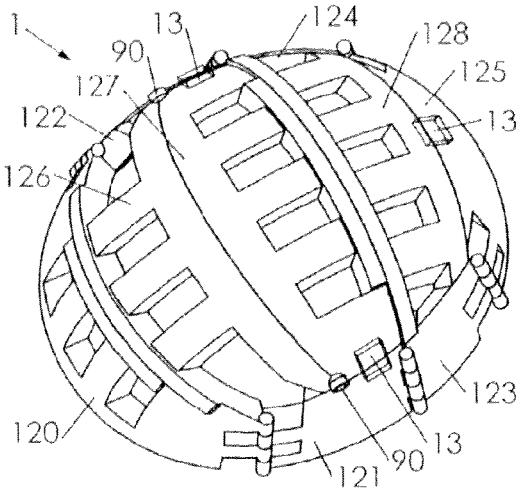
Figure 103:
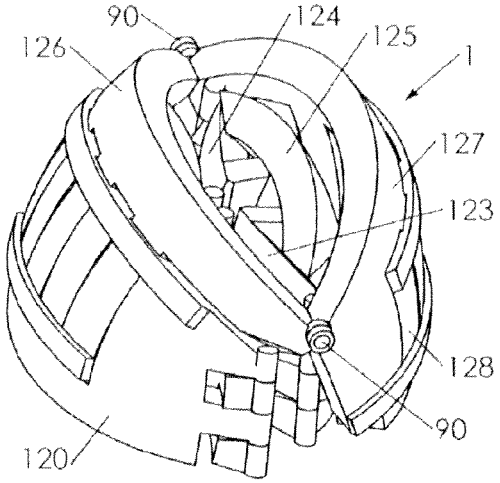
Figure 104:
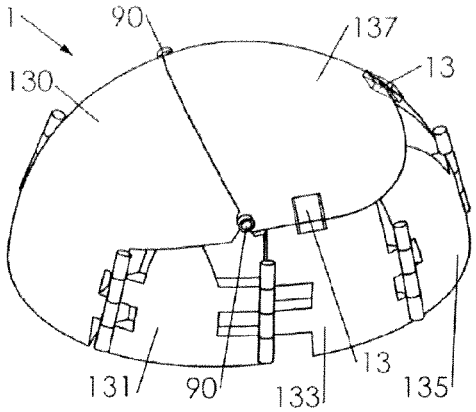
Figure 105:
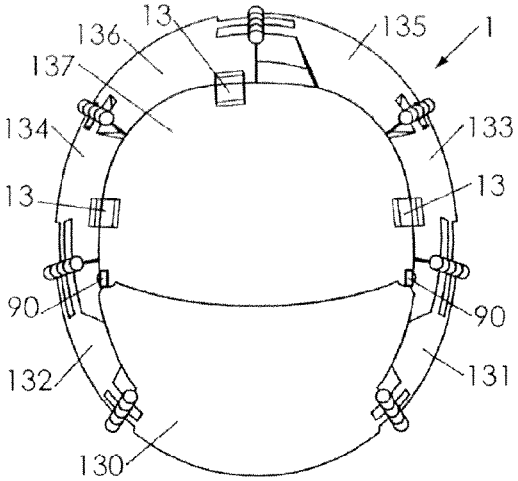
Figure 106:
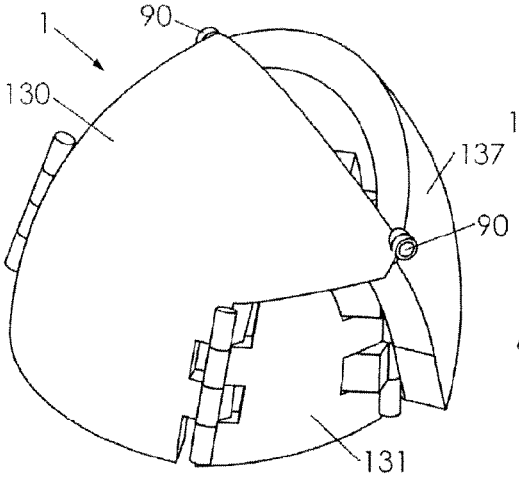
Figure 107:
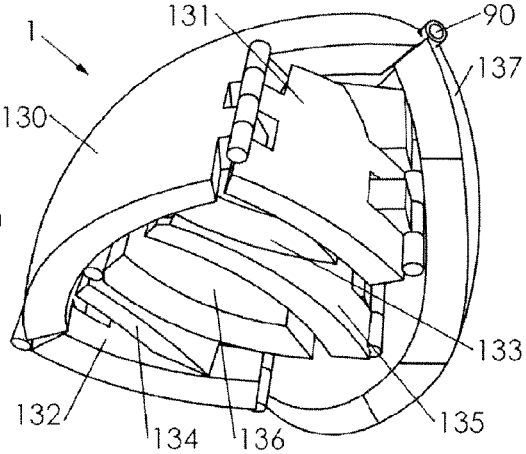
Figure 108:
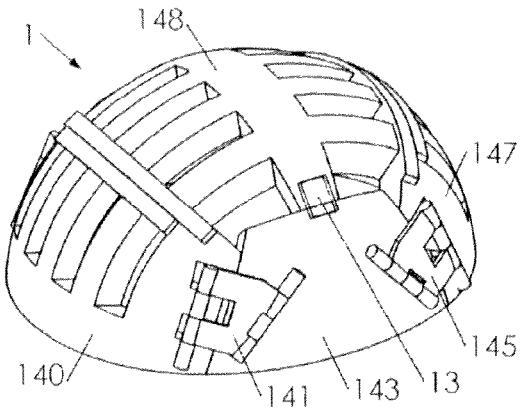
Figure 109:
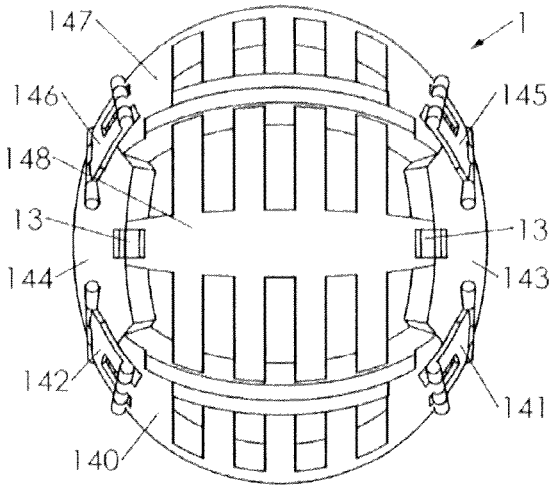

According to another variant shown in FIGS. 102 and 103, the helmet 1 is composed of peripheral segments 120, 121, 122, 123, 124, 125 and central segments 126, 127, 128. The peripheral segments are connected to each other in pairs through a hinge connection 30. The segments 120 and 126 are connected by a sliding connection 31, in the same way as segments 127 and 128. Segments 126 and 127 are connected to each other by a pivot connection 90. The helmet 1 also comprises three locking devices 13, connecting firstly the segment to segments 121 and 122, and secondly segment 128 to segment 125.

According to another variant shown in FIGS. 104 to 107, the helmet 1 is composed of peripheral segments 130, 131, 132, 133, 134, 135, 136 and a central segment 137. The peripheral segments are connected to each other in pairs, through a hinge connection 30. The central segment 137 is connected to the segment 130 by means of a pivot connection 90. This helmet 1 also comprises three locking devices 13 connecting the segment 137 to segments 133, 134 and 136.

Figure 110:
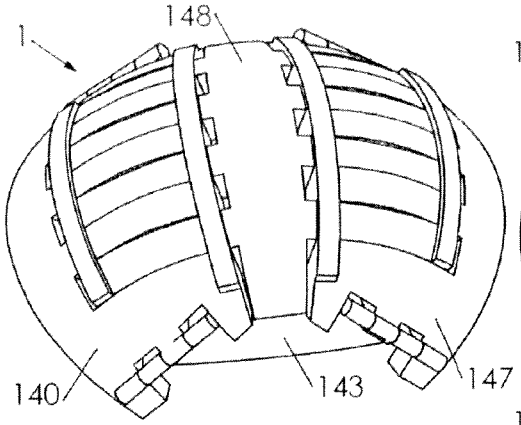
Figure 111:
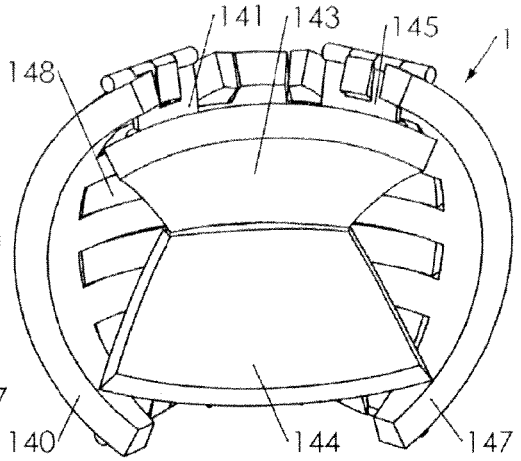
Figure 112:
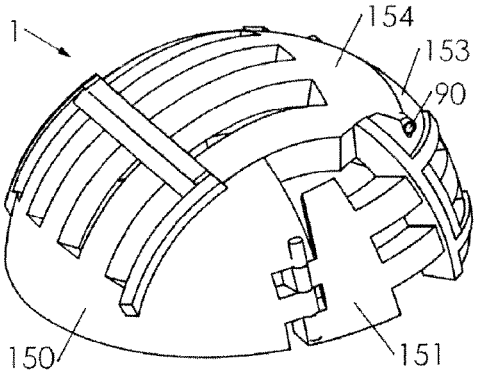
Figure 113:
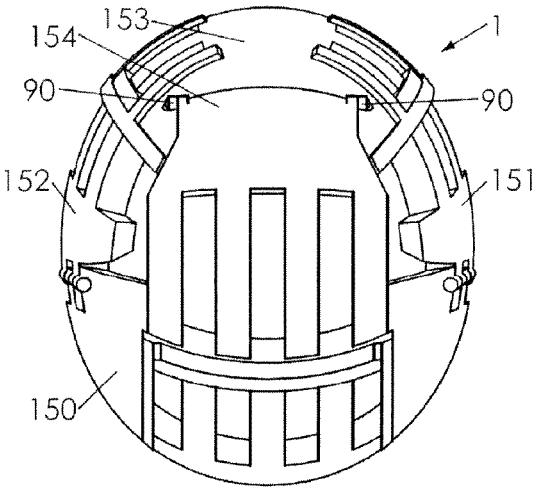
Figure 114:
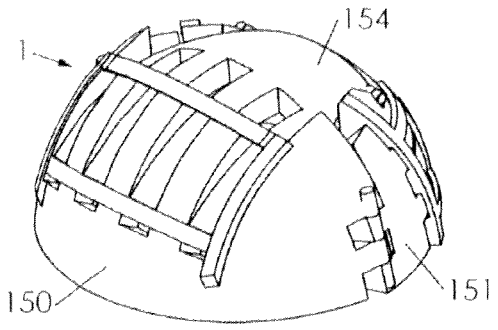
Figure 115:
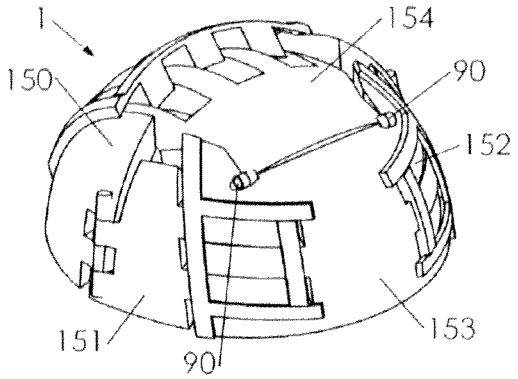
Figure 116:
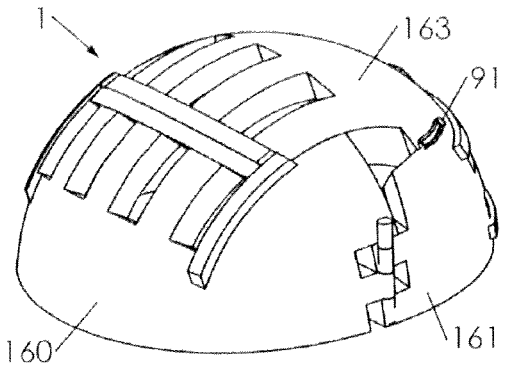
Figure 117:
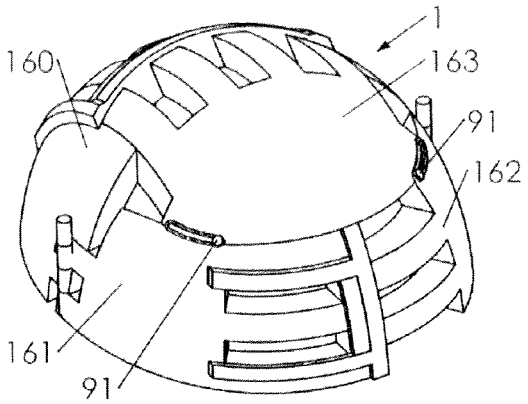
Figure 118:
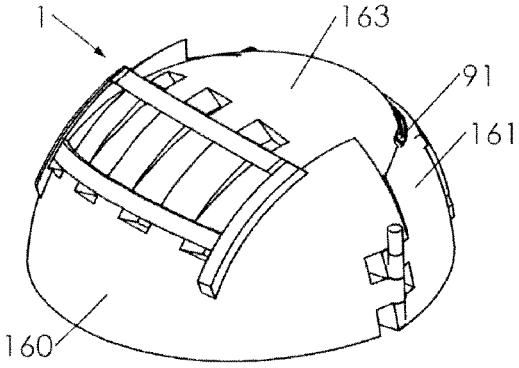
Figure 119:
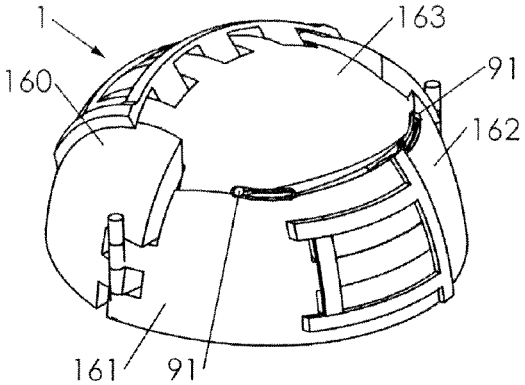

According to another variant shown in FIGS. 108 to 111, the helmet 1 is composed of peripheral segments 140, 141, 142, 143, 144, 145, 146, 147 and the central segment 148. Segment 148 is connected to segments 140 and 147 through a sliding connection 31. A hinge connection 30 connects the peripheral segments to each other in pairs, in other words segments 140 and 141, 140 and 142, 147 and 145, 147 and 146, 143 and 141, 143 and 145, 144 and 142, 144 and 146. The helmet 1 also comprises two locking devices 13 connecting segment 148 to segments 143 and 144. Segments 141 and 145 are thin, so that they partially cover segment 143, and segments 142 and 146 are also thin and partially cover the segment 144. Segments 141, 142, 145 and 146 may not be thin, in this case they do not cover segments 143 and 144. When the two locking devices 13 are unlocked, the two segments 143 and 144 can move, through the hinge connections 30 connecting the peripheral segments, towards the inside of the helmet 1 to be housed below the segment 148. During this time, the segments 140 and 147 are engaged in the segment 148 through the sliding connections 31. The helmet 1 thus folded is shown in FIGS. 110 and 111.

In the embodiment shown in FIGS. 96 to 111, each peripheral segment is connected to the adjacent peripheral segment by means of a hinge connection 30. The number of peripheral segments can vary. It may be advantageous if the hinge pins of one or several groups or all hinge connections 30 connecting the peripheral segments are parallel or concurrent with each other.

The number of central segments can also vary. The connection and locking means connecting central segments to each other and to peripheral segments can vary in number and can be combined differently.

According to another embodiment shown in FIGS. 112 to 115, the helmet 1 is composed of peripheral segments 150, 151, 152, 153 and a central segment 154. The segment 150 is connected to segments 151 and 152 through hinge connection 30. The segment 153 is connected to segments 151 and 152 through a sliding connection 31. The segment 154 is connected to segment 150 through a sliding connection 31 and to segment 153 through a pivot connection 90.

According to another variant shown in FIGS. 116 to 119, the helmet 1 is composed of peripheral segments 160, 161, 162 and the central segment 163. The segment 160 is connected to segments 161 and 162 through a hinge connection 30. Segments 161 and 162 are connected through a sliding connection 31. Segment 163 is connected to segment 160 through a sliding connection 31. The segment 163 is connected to segment 161 and to segment 162 by annular linear connections 91, providing guidance in translation between the two associated segments.

Figure 120:
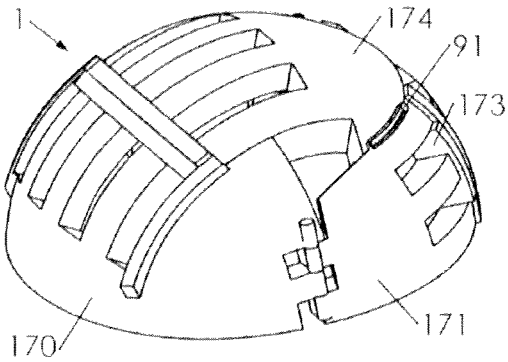
Figure 121:
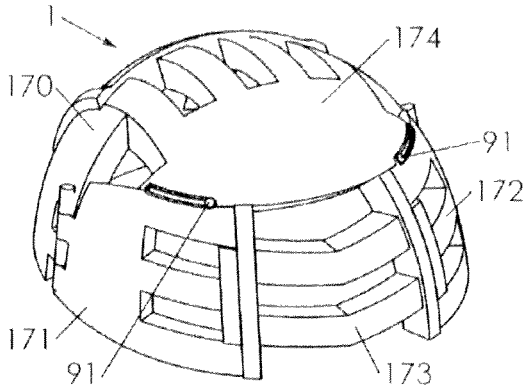
Figure 122:
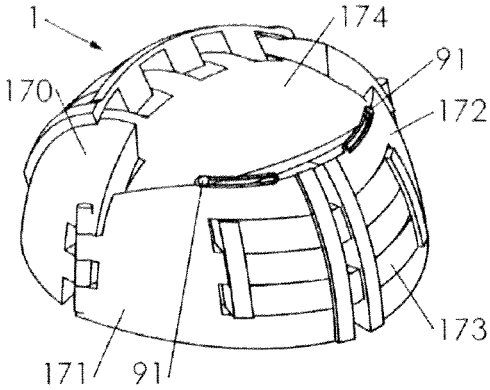

According to another variant shown in FIGS. 120 to 122, the helmet 1 is composed of peripheral segments 170, 171, 172, 173 and the central segment 174. The segment 170 is connected to segments 171 and 172 by a hinge connection 30. Segments 170 and 174 are connected through a sliding connection 31. The segment 174 is connected to segments 171 and 172 through annular linear connections 91. The segment 173 is connected to segments 171 and 172 through a sliding connection 31. The indentations 5 of the two sliding connections of the segment 173 join together at the centre of the segment, the protrusions 6 then not being connected to each other except by transverse bars. As a variant, the indentations 5 do not necessarily join together at the centre.

Figure 123:
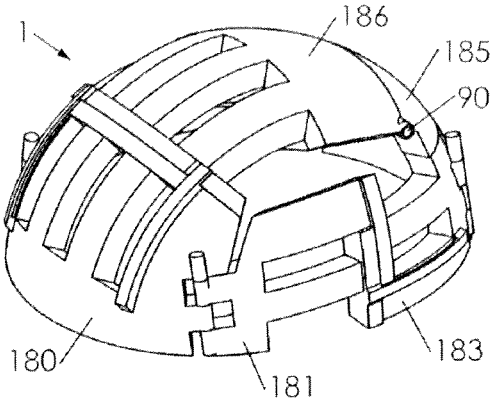
Figure 124:
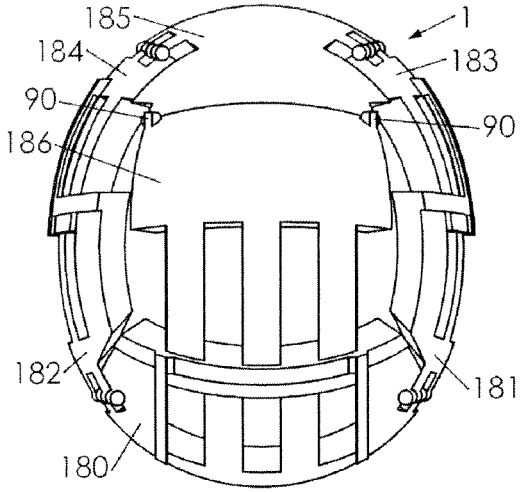
Figure 125:
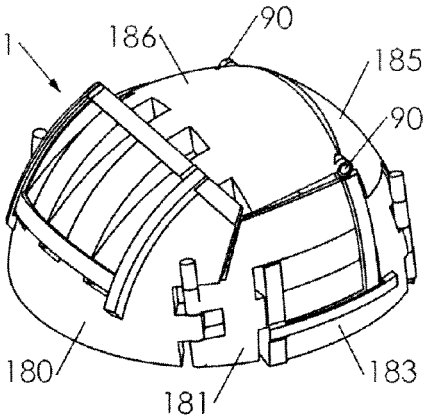

According to another variant shown in FIGS. 123 to 125, the helmet 1 is composed of peripheral segments 180, 181, 182, 183, 184, 185 and the central segment 186. Segment 180 is connected to segments 181 and 182 through a hinge connection 30. Segment 185 is connected to segments 183 and 184 through a hinge connecting 30. Segments 181 and 183 are connected together through a sliding connection 31, as are segments 182 and 184. Segment 186 is connected firstly to segment 180 through a sliding connection 31 and secondly to segment 185 through a pivot connection 90.

Figure 126:
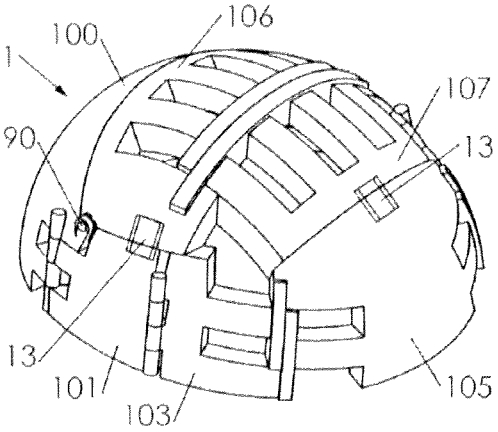
Figure 127:
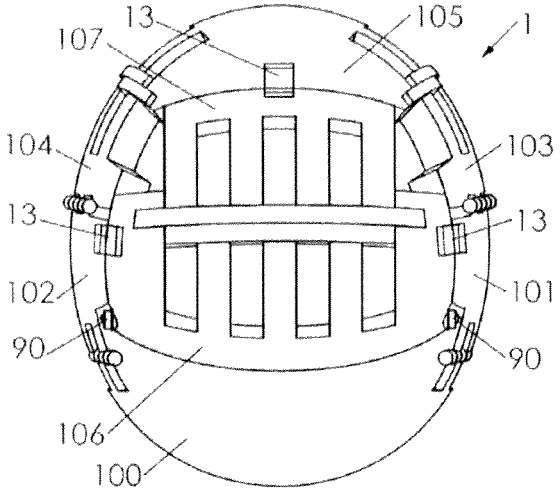
Figure 128:
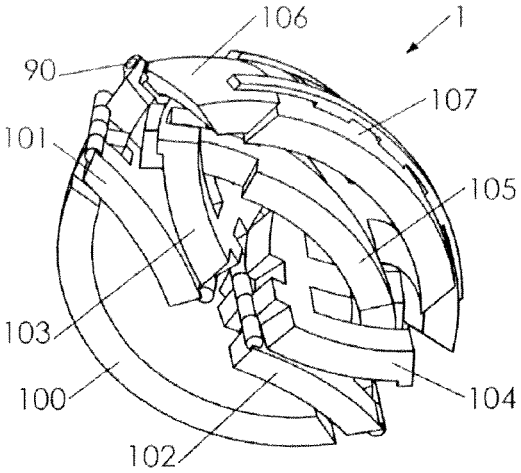

According to another variant shown in FIGS. 126 to 128, the helmet 1 is similar to the helmet in FIG. 96, but the hinge connections 30 connecting the segments 105 to segments 103 and 104 are replaced by sliding connections 31.

In the embodiments 112 to 128, each peripheral segment is connected to the adjacent peripheral segment by means of a hinge connection 30 or a sliding connection 31. Obviously, the number of peripheral segments and the arrangement of hinge and sliding connections can vary.

Each segment connected through a sliding connection 31 may be provided with at least one guide part 25 and/or at least one slat 29 as described above.

The number of central segments can also vary. The connection and locking means connecting the central segments to each other and to the peripheral segments may vary in number and may be combined differently.

The locking systems of the helmet 1 are not shown for these embodiments. Obviously, they may be in the same form as locking devices 13 described above, but it may be advantageous to provide the helmet 1 with at least one system holding sliding connections 31 in an intermediate position between the completely extended position in which indentations 5 are unoccupied and the folded position in which the indentations are occupied by the protrusions 6 of the complementary segment, to adapt the size and shape of the helmet 1 to the user's head. This system for holding the sliding connections 31 in an intermediate position may consist of a tooth and ratchet system or a rack and pinion system. This system may be fixed directly onto the segments, the rack or the teeth for example being located on the protrusions 6 of one segment and the ratchet or the pinion system being located on the transverse bar fixed to the complementary segment. This retaining system may also be connected to segments using a strap or a band, for example like the head band usually used on cycle helmets. In this configuration, said straps or head hands are not necessarily fixed on adjacent segments.

Figure 129:
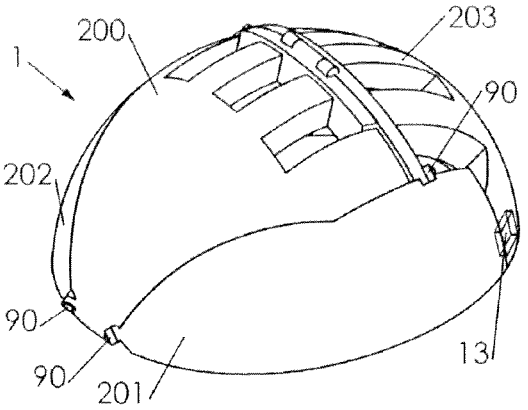
Figure 130:
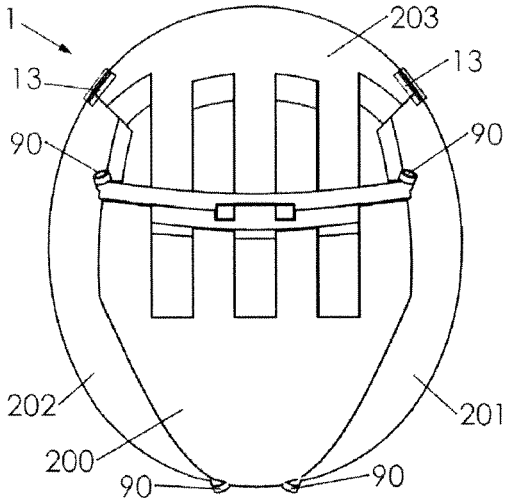
Figure 131:
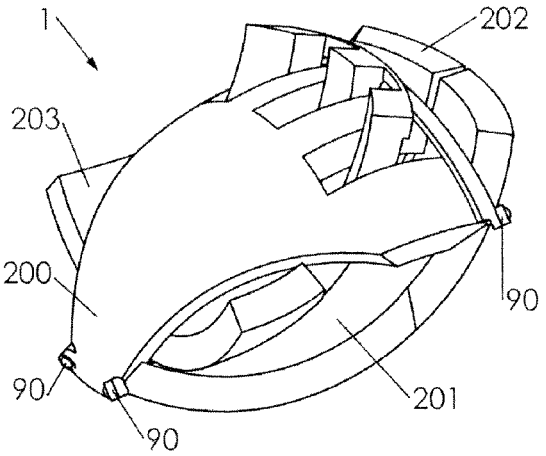
Figure 132:
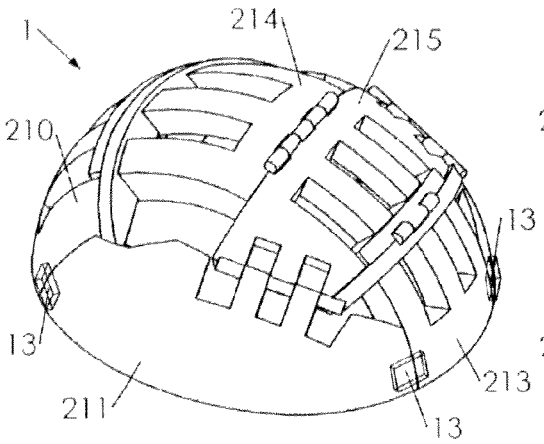
Figure 133:
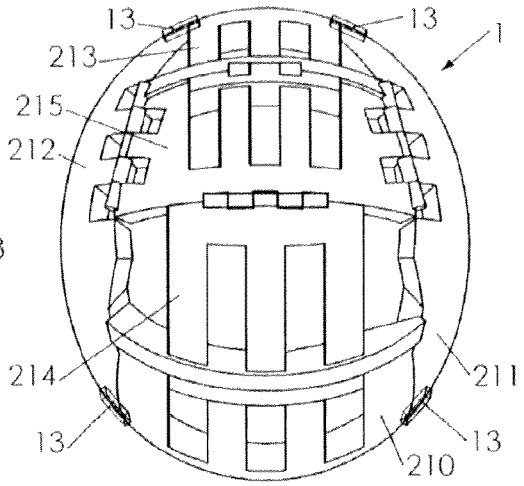
Figure 134:
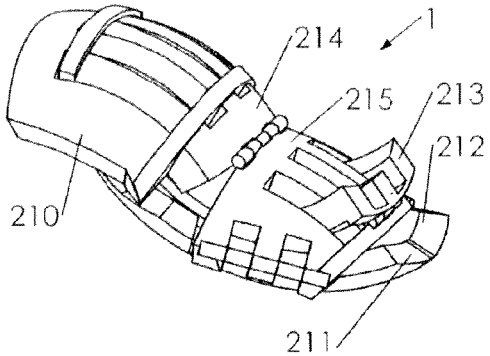
Figure 135:
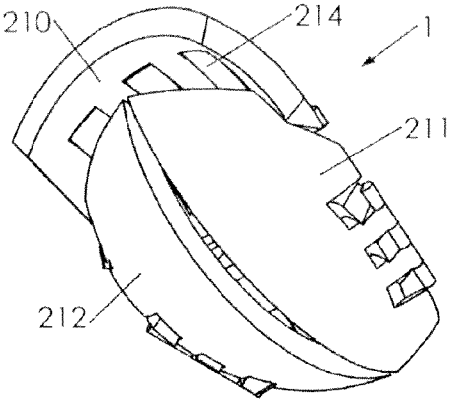
Figure 136:
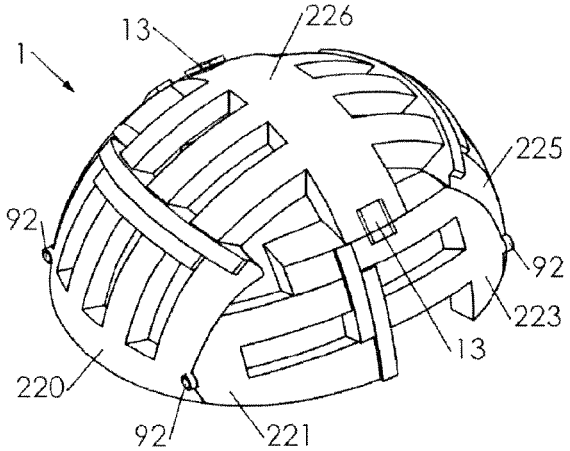
Figure 137:
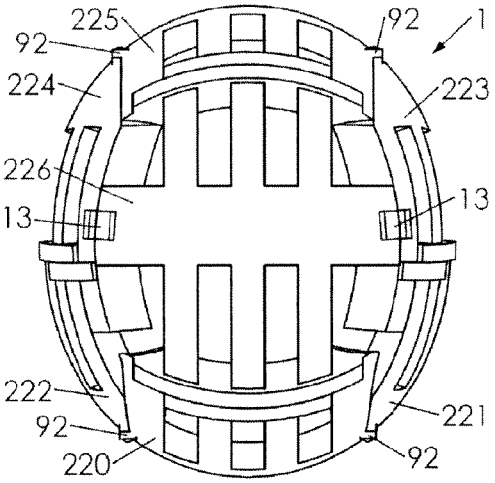
Figure 138:
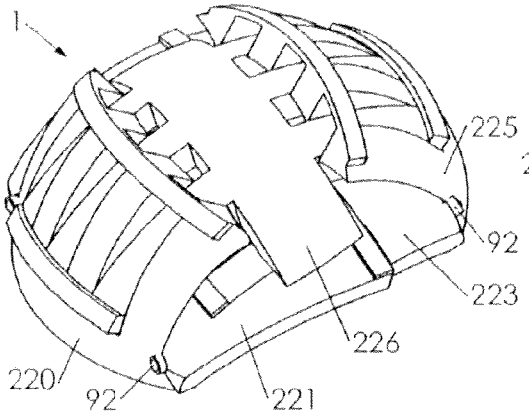
Figure 139:
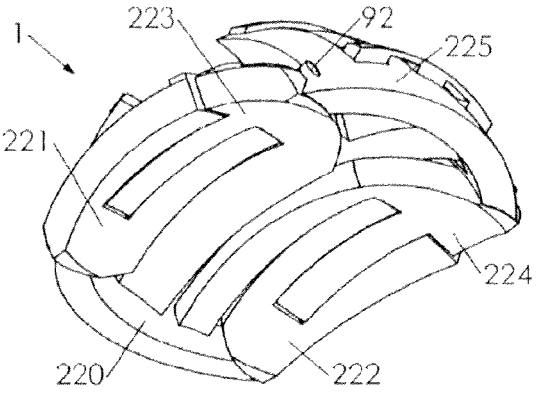
Figure 140:
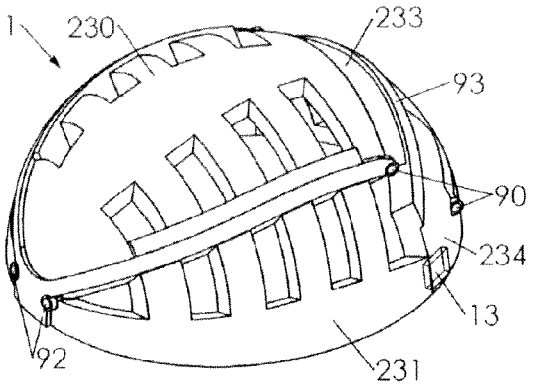
Figure 141:
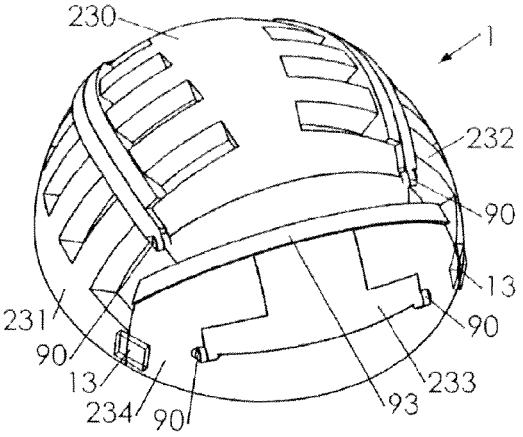
Figure 142:
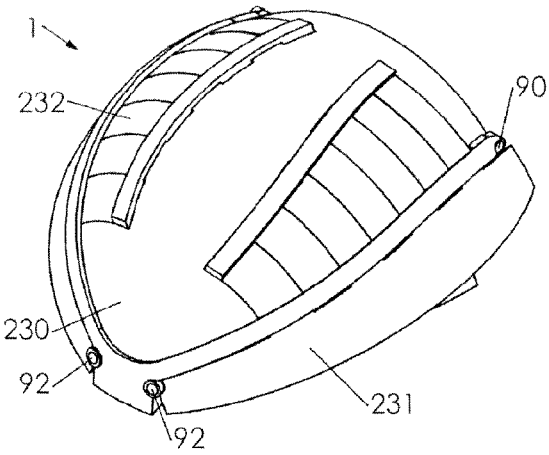
Figure 143:
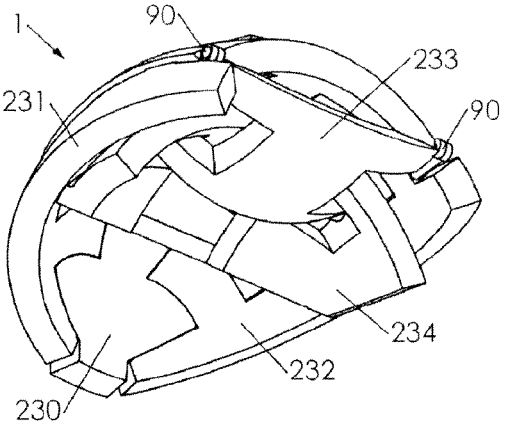

According to an her variant shown in FIGS. 129 to 131, the helmet 1 is composed of segments 200, 201, 202, 203. Segment 200 is connected to segments 201 and 202 through a pivot connection 90. Segment 200 is connected to segment 203 through a hinge connection 30. The helmet 1 comprises two locking devices 13 connecting segment 203 to segments 201 and 202.

According to another variant shown in FIGS. 132 to 135, the helmet 1 is composed of peripheral segments 210, 211, 212, 213 and central segments 214, 215. Segments 210 and 214 are connected through a sliding connection 31. Segment 215 is connected to segments 211, 212, 213 and 214 through a hinge connection 30. The helmet 1 also comprises four locking devices 13 connecting firstly segment 210 to segments 211 and 212, and secondly segment 213 to segments 211 and 212.

The sliding connection 31 connecting segments 210 and 214 may be replaced by a hinge connection 30. The hinge connection 30 connecting segments 213 and 215 may be replaced by a sliding connection 31.

According to another variant shown in FIGS. 136 to 139, the helmet 1 is composed of peripheral segments 220, 221, 222, 223, 224, 225 and the central segment 226. A sliding connection 31 connects segments 221 and 223, and a sliding connection 31 connects segments 222 and 224. A sliding connection 31 also connects segment 226 to segments 220 and 225. A hinge point 92 connects segment 220 to segments 221 and 222, and also segment 225 to segments 223 and 224.

According to another variant shown in FIGS. 140 to 143, the helmet 1 is composed of segments 230, 231, 232, 233, 234. A sliding connection 31 connects segment 230 to segments 231 and 232. An optional hinge point 92 also connects segment 230 to segments 231 and 232. A pivot connection 90 connects segment 233 to segments 230 and 234. A rod 93 fixed to segment 234 limits the rotation movement between segments 233 and 234 through the pivot connection 90. The helmet 1 also comprises two locking devices 13 connecting segment 234 to segments 231 and 232.

The helmet 1 does not necessarily have any segment 233, segment 234 is then directly connected to segment 230, for example through a pivot connection 90.

Figure 144:
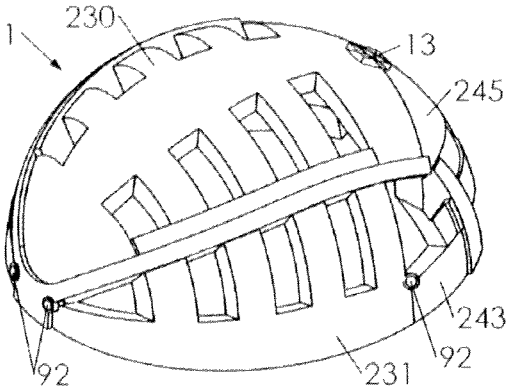
Figure 145:
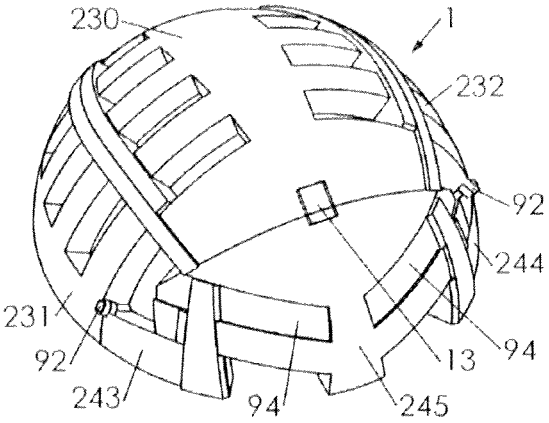
Figure 146:
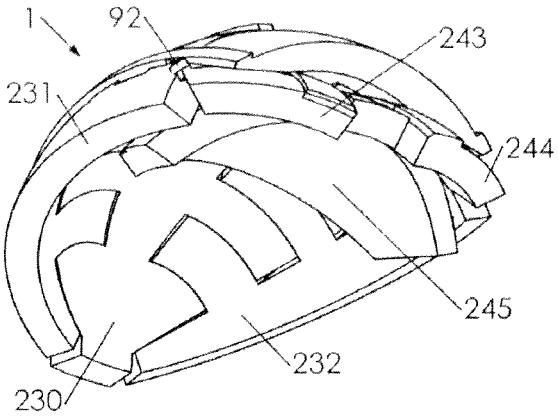

According to another variant shown in FIGS. 144 to 146, the helmet 1 is composed of segments 230, 231, 232, 243, 244 and 245. Segment 230 is connected to segments 231 and 232 in a manner similar to the embodiment of the helmet shown in FIGS. 140 to 143. Segments 231 and 243 are connected by a hinge point 92, as are segments 232 and 244. Segment 245 is connected to segments 243 and 244 through a sliding connection 31. These two sliding connections 31 may comprise a knuckle 35 and groove 36 system similar to that shown in FIGS. 26 to 28. The two thinner zones 94 of the segment 245 may replace the indentations 5 passing through the sliding connections 31. The helmet 1 also comprises a locking device 1' connecting segments 230 and 245. When moving to the folded position, the segment 245 is positioned under the segment 230.

Figure 147:
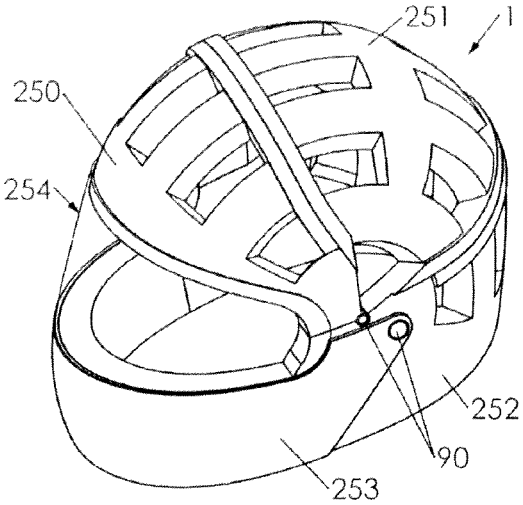
Figure 148:
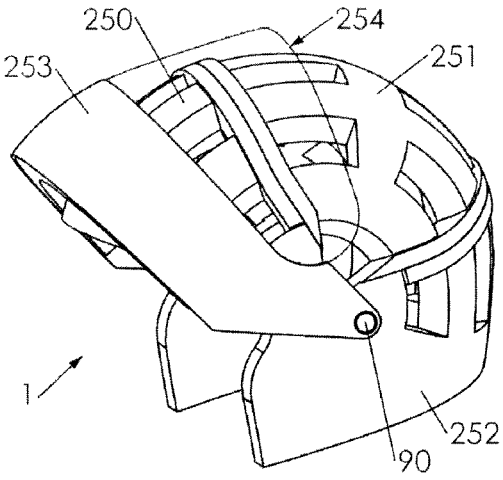
Figure 149:
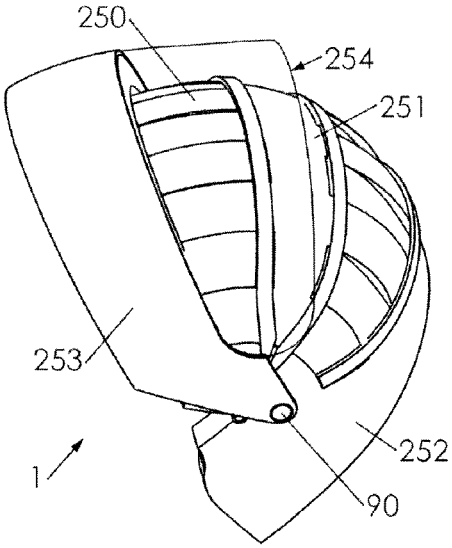

According to another variant shown in FIGS. 147 to 149, the helmet 1 is composed of segments 250, 251, 252, a chin strap 253 and a visor 254. The segment 251 is connected to segments 250 and 252 through a sliding connection 31. Segments 250 and 252 are connected through a pivot connection 90. The chin strap 253 fixed to the visor 254 is free to move through a pivot connection 90 for example connecting it to the segment 252. Obviously, the chin strap 253 and the visor 254 may be free to move relative to each other. The helmet 1 does not necessarily have a chin strap 253 and/or a visor 254. The pivot connection 90 connecting segments 250 and 252 may be replaced by two pivot connections 90 connecting the segment 251 to segments 250 and 252. FIG. 148 shows the helmet 1 in the extended position with the chin strap 253 raised.

The number and geometry of indentations 5 and protrusions 6 shown in the figures can obviously fury, since the different embodiments are only given as examples.

The shapes of the locking device 13 shown for the different embodiments may be different from those described above.

The figures showing variants of the helmet 1 in the folded position, do not show the locking device 13 for reasons of clarity.

Obviously, other embodiments using different combinations of the different means described could be envisaged. In particular, on the described helmet variants, it would be possible to position segments on the helmet differently, for example by swapping the length and the width of the helmet.

In the different embodiments of helmets, the hinge connections 30 may be replaced by conventional pivot connections or by flexible or semi-rigid connections.

Each connection and locking means in the embodiments of helmets described connects two segments to each other. Other variants could be envisaged in which these means connect more than two segments at the same time.

Figure 150:
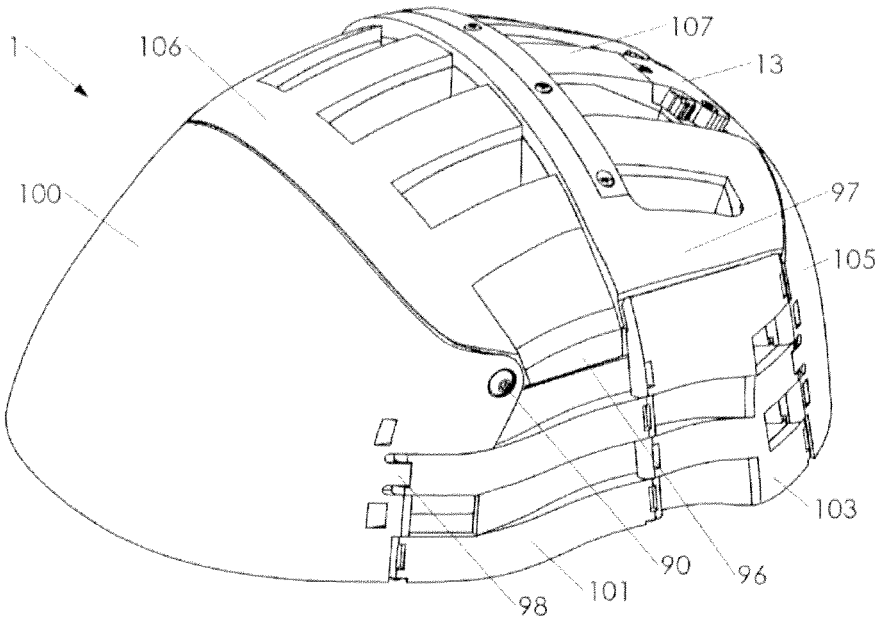
FIGS. 150 to 152 show a particular variant of the helmet.
Figure 152:
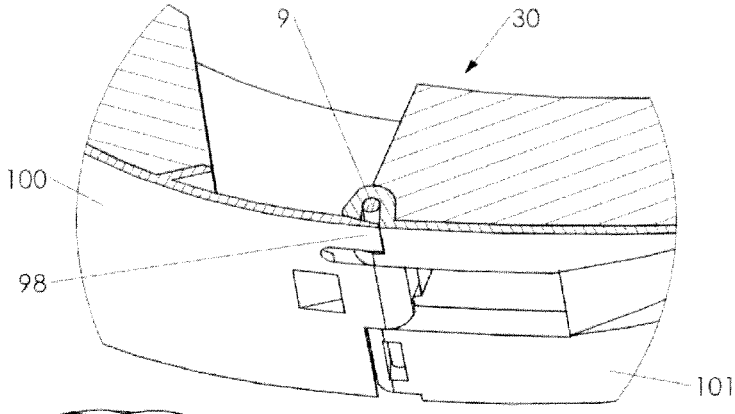
Figure 151:
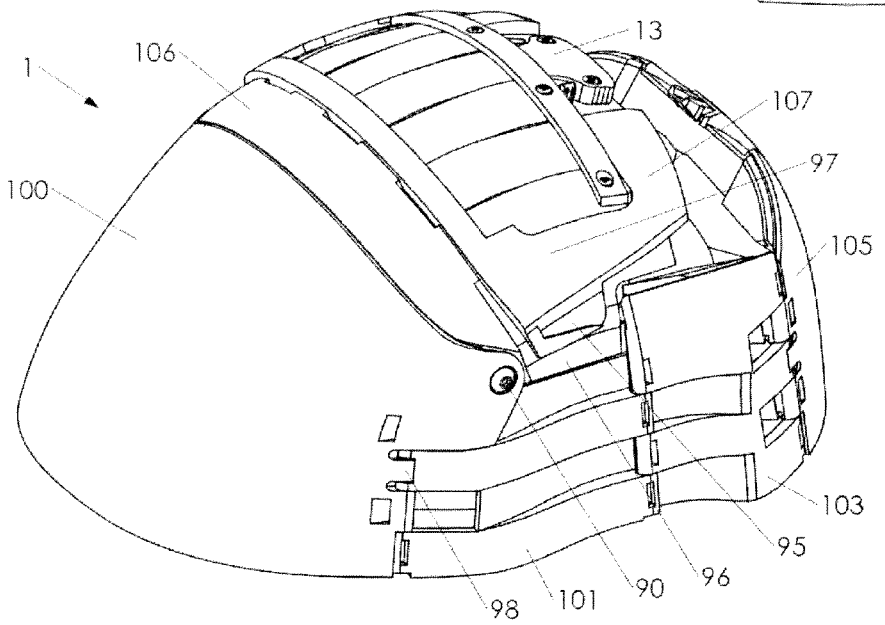

FIGS. 150 to 152 show a particular variant embodiment of the helmet 1 shown in FIGS. 96 to 99; FIG. 150 shows the helmet 1 in the extended position, FIG. 151 shows the helmet 1 in an intermediate position between the extended position and the folded position, and FIG. 152 is a detailed sectional view of a hinge connection 30 located on the helmet shown in FIGS. 150 and 151. In the same way as above, the helmet 1 shown in these figures comprises peripheral segments 100, 101, 103, 105, 102 and 104 (the latter two not being shown in FIGS. 150 and 151) and two central segments 106 and 107.

In this variant, sons of the hinge connections 30 are provided with at least one mechanism applying a return force that determines one or several stable positions. The return mechanism may comprise an elastic means such as a leaf spring, a spiral spring, a helical spring or an elastic lip like that shown in FIGS. 150 to 152, associated with a segment with a non-circular profile, typically a cam profile, in order to facilitate manipulation of the helmet 1. In this example, the elastic lip 98 is fixed to a segment 100 of the helmet 1 and cooperates with a segment 101 that has a cam profile that will give one or several stable positions. The lip may also be used as a rotation stop for the hinge connection 30.

This mechanism applying a return force can advantageously be combined with knuckles forming the hinge connection 30 that comprise openings arranged alternately on each side of the outer surface of the helmet 1 as described above.

The variant shown in FIGS. 150 and 151 also comprises at least one overlap element 97 fixed to segment 107 and the bar of segment 107, at least partially covering a protrusion of the segment 106. The effect of this embodiment is to limit the rotation movement of the sliding connection 31 that connects segments 106 and 107 by forming a stop, particularly when these segments are in the folded position.

Furthermore, in this helmet variant, the segment 107 comprises two stops 95 on each side of the helmet 1 that limit displacement of segments 101, 103 and displacement of segments 102, 104 (not shown in these figures), inwards into the helmet 1.

When the helmet 1, or more precisely the segment 107 is in the extended position, the stop 95 limits displacement of segments 101 and 103 by cooperating with one of the two segments, typically segment 103 in the embodiment shown in FIGS. 150 and 151. Similarly, displacement of peripheral segments 102 and 104 facing segments 101 and 103 is limited by a stop similar to stop 95.

Once the locking device 13 connecting the segments 105 and 107 has been unlocked, the engagement of segment 107 in segment 106 through the sliding connection 31 makes it possible to fold segments 101, 102, 103 and 104 inwards, thus allowing folding of the helmet 1. The segments 101, 102, 103, 104 are preferably limited in displacement towards the outside of the helmet 1 by stops located on segments 100, 106 or 107. On the variant shown, two stops 96 located on each side of the segment 106 limit outwards displacements of segments 101, 103 and of segments 102, 104 (not shown in FIGS. 150 and 151).

These stops 95 replace locking devices, thus reducing the number of locking devices included in helmet 1.

For example, the global structure of the variant helmet shown in FIGS. 96 to 99 is similar to the global structure of the helmet shown in FIGS. 150 and 151, but this first variant comprises three locking devices 13 while the variant shown in FIGS. 150 and 151 comprises a single looking device 13 in combination with two stops 95, this single locking device 13 making it possible to lock displacement of the segment 107.

According to another embodiment, the helmet 1 is similar to that shown in FIGS. 150 and 151, but segments 100 and 106 are fixed forming a single segment. The pivot connection 90 connecting these two segments is then eliminated.

The invention claimed is:

1. A protective helmet comprising a plurality of segments, at least two of said segments being connected to each other by means of a sliding connection, said segments connected by said sliding connection being provided with indentations and approximately parallel complementary rigid protrusions, wherein for each sliding connection, the protrusions from each of the segments are connected to each other by means of a transverse bar located at their ends, said transverse bars being adapted to maintain a connection between the two segments of a sliding connection, the two segments of said sliding connection being movable between a folded position, in which the indentations of the first segment are occupied by the rigid protrusions of the second segment and an extended position in which the transverse bars prevent any disengagement, further comprising two central segments and peripheral segments, the two central segments being connected to each other by a sliding connection, and the peripheral segments being connected in pairs by means of a hinge connection, wherein one of the two central segments is connected to a first peripheral segment by a pivot connection and one of the two central segments is connected to at least one other peripheral segment by a locking device, wherein the helmet is configured such that:

when locked, said locking device holds the helmet fixed in an extended position;

when unlocked, said locking device enables displacement of said peripheral segments in order to fold them down inside the helmet through hinge connections and enables the pivoting of the first of the two central segments toward the first peripheral segment around the pivot connection, thus bringing the helmet into a folded position.

2. The protective helmet of claim 1, wherein the two central segments are provided with indentations and approximately parallel complementary rigid protrusions, wherein said indentations and rigid protrusions extend through the entire thickness of said two central segments, and where, in the folded position, the indentations of one of the two segments are occupied by the rigid protrusions of the other of the two segments, and in the extended position, the indentations are free and form openings or vents through the helmet.

3. The protective helmet according to claim 1, wherein one of the sliding connections comprises at least one overlap element fixed to a corresponding one of said segments and to the transverse bar of said segment, said overlap element being superposed on at least one of the protrusions from the other of the two segments of the same sliding connection.

4. The protective helmet according to claim 1, wherein at least one of the ends of said transverse bars extends beyond the protrusions, said ends of the transverse bars extending beyond the protrusions are guided in displacement by guide elements arranged along the indentations.

5. The protective helmet according to claim 1, wherein at least one of the indentations is at least partially covered by a guide element, said guide element being adapted to guide the displacement of the segment complementary to the segment of the sliding connection comprising said at least one indentation.

6. The protective helmet according to claim 4, wherein said guide elements extend over less than the entire length of said indentations.

7. The protective helmet according to claim 1, wherein at least one slat covers at least one of said at least one protrusions and one indentation of one of the two segments of the sliding connection, defining an internal space between said at least one slat and said segment, and being adapted to guide the displacement of the transverse bar of the other of the two segments of the sliding connection.

8. The protective helmet according to claim 1, wherein at least one of said at least one protrusions and at least one of said indentations of a first segment of the sliding connection is covered by a first shell, said first shell defining an internal space between the first shell and the first segment, and being adapted to guide the displacement of the transverse bar of the second segment of the sliding connection associated with said first segment.

9. The protective helmet according to claim 8, wherein at least one of the at least one protrusions and at least one of said indentations of said associated segment of the sliding connection is covered by a second shell, said second shell defining a second internal space between the second shell and the associated segment, and being adapted to enable displacement of the first shell and the transverse bar of the first segment of the sliding connection.

* * * * *